US009382490B2

(12) United States Patent
Brewer et al.

(10) Patent No.: US 9,382,490 B2
(45) **Date of Patent: *Jul. 5, 2016**

(54) COMPOSITIONS

(71) Applicant: Shell Oil Company, Houston, TX (US)

(72) Inventors: Mark Lawrence Brewer, Chester (GB); Roger Francis Cracknell, Chester (GB); Tor Kit Goh, Damansara Heights (MY)

(73) Assignee: Shell Oil Company, Houston, TX (US)

( * ) Notice: Subject to any disclaimer, the term of this patent is extended or adjusted under 35 U.S.C. 154(b) by 46 days.

This patent is subject to a terminal disclaimer.

(21) Appl. No.: 14/134,382

(22) Filed: Dec. 19, 2013

(65) Prior Publication Data

US 2014/0187454 A1 Jul. 3, 2014

(30) Foreign Application Priority Data

Dec. 27, 2012 (EP) ..... 12199496
Sep. 13, 2013 (EP) ..... 13184382

(51) Int. Cl.
*C10L 10/12* (2006.01)
*C10L 1/183* (2006.01)
(Continued)

(52) U.S. Cl.
CPC ..... *C10L 1/1802* (2013.01); *C10L 1/1826* (2013.01); *C10L 1/1981* (2013.01); *C10L 1/1985* (2013.01);
(Continued)

(58) Field of Classification Search
CPC ... C10L 1/1802; C10L 1/1826; C10L 1/1981; C10L 1/1985; C10L 1/23; C10L 2270/023; C10L 1/1988; C10L 2270/026; C10L 2230/14; C10L 10/12; C10L 1/232; C10L 1/223; C10L 2230/081; C10M 161/00; C10M 145/40; C10M 2207/026; C10M 2209/12; C10N 2230/02; C10N 2250/16; C10N 2230/10
USPC ..... 44/322, 436
See application file for complete search history.

(56) References Cited

U.S. PATENT DOCUMENTS 3,314,884 A 4/1967 Cover
3,453,257 A * 7/1969 Parmerter ..... C08B 37/0012 131/355

(Continued)

FOREIGN PATENT DOCUMENTS

EP 948584 10/1999
FR 2484252 12/1981

(Continued)

OTHER PUBLICATIONS

Marques; "A review on cyclodextrin encapsulation of essential oils and volatiles"; Flavour Frager J.; vol. 25; pp. 313-326; 2010.

(Continued)

*Primary Examiner* — Pamela H Weiss

(57) ABSTRACT

Additive composition for use in a fuel or lubricant formulation, comprising an active substance in an inclusion complex with a modified cyclodextrin of formula (I):

(I)

wherein n is an integer from 6 to 20, and $R^1$, $R^2$ and $R^3$ are each independently selected from hydrogen, optionally substituted alkyl, optionally substituted aryl and carbonyl, provided that $R^1$, $R^2$ and $R^3$ are not all hydrogen. Also provided is a fuel or lubricant formulation comprising the additive composition, a premix for use in preparing the additive composition, and the use of a modified cyclodextrin (I) as a vehicle for an active substance in an additive composition or in a fuel or lubricant formulation.

11 Claims, 8 Drawing Sheets

(51) Int. Cl.

| | |
|---|---|
| ***C10L 1/182*** | (2006.01) |
| ***C10L 1/10*** | (2006.01) |
| ***C10L 1/08*** | (2006.01) |
| ***C10L 1/18*** | (2006.01) |
| ***C10M 145/40*** | (2006.01) |
| ***C10M 161/00*** | (2006.01) |
| ***C10L 1/198*** | (2006.01) |
| *C10L 1/223* | (2006.01) |
| *C10L 1/232* | (2006.01) |
| *C10L 1/23* | (2006.01) |

(52) U.S. Cl.

CPC ..... *C10M 145/40* (2013.01); *C10M 161/00* (2013.01); *C10L 1/1988* (2013.01); *C10L 1/223* (2013.01); *C10L 1/23* (2013.01); *C10L 1/232* (2013.01); *C10L 10/12* (2013.01); *C10L 2230/081* (2013.01); *C10L 2230/14* (2013.01); *C10L 2270/023* (2013.01); *C10L 2270/026* (2013.01); *C10M 2207/026* (2013.01); *C10M 2209/12* (2013.01); *C10N 2230/02* (2013.01); *C10N 2230/10* (2013.01); *C10N 2250/16* (2013.01)

(56) References Cited

U.S. PATENT DOCUMENTS

| | | | | |
|---|---|---|---|---|
| 4,515,740 | A | 5/1985 | Schuettenberg et al. | |
| 5,199,959 | A | 4/1993 | Sung et al. | |
| 5,226,925 | A | 7/1993 | DeRosa et al. | |
| 5,349,188 | A | 9/1994 | Maggard | |
| 5,470,358 | A | 11/1995 | Gaughan | |
| 5,482,520 | A | 1/1996 | Alam et al. | |
| 6,110,306 | A * | 8/2000 | Consaga | C06B 25/02 149/1 |
| 6,805,816 | B1 | 10/2004 | Groenendaal et al. | |
| 6,858,048 | B1 | 2/2005 | Jimeson et al. | |
| 2001/0003231 | A1 | 6/2001 | Ford et al. | |
| 2004/0099838 | A1 | 5/2004 | Leck et al. | |
| 2005/0035045 | A1 | 2/2005 | Colucci | |
| 2006/0225340 | A1 | 10/2006 | Gaughan et al. | |
| 2007/0225490 | A1 * | 9/2007 | Ching | B01J 20/262 536/123.1 |
| 2008/0168706 | A1 | 7/2008 | Rusek et al. | |
| 2010/0160623 | A1 | 6/2010 | Strassburger | |

FOREIGN PATENT DOCUMENTS

| | | |
|---|---|---|
| JP | 1210497 | 8/1989 |
| RU | 2235117 | 8/2004 |
| WO | 9940166 | 8/1999 |
| WO | 0049108 | 8/2000 |
| WO | 0200812 | 1/2002 |
| WO | 0222766 | 3/2002 |
| WO | 03004146 | 1/2003 |
| WO | 03018726 | 3/2003 |
| WO | 03018727 | 3/2003 |
| WO | 03018988 | 3/2003 |
| WO | 03083017 | 10/2003 |
| WO | 2005003265 | 1/2005 |
| WO | 2005052096 | 6/2005 |
| WO | 2005123238 | 12/2005 |
| WO | 2006105025 | 10/2006 |
| WO | 2008073118 | 6/2008 |
| WO | 2008076759 | 6/2008 |
| WO | 2009050287 | 4/2009 |
| WO | 2010001341 | 1/2010 |
| WO | 2010014528 | 2/2010 |
| WO | 2010132209 | 11/2010 |

OTHER PUBLICATIONS

Chemical Reviews; vol. 98; pp. 2035-2044.

Hedges A R: "Industrial applications of cyclodextrins", Chemical Reviews, American Chemical Society, US, vol. 98, No. 5, pp. 2035-2044, 1998, XP002453286.

Menger, F.M. et al.: "Chemistry of a heptane-soluble cyclodextrin derivative", Tetrahedron Letters, vol. 26, No. 3, 1985, pp. 267-270, XP002721690.

Nakai Y., et al.: "Effects of grinding on the physical and chemical properties of crystalline medicinals with microcrystalline cellulose V: comparison with tri-O-methyl-beta-cyclodextrin ground mixtures", Chem. Pharm. Bull. vol. 28, No. 5, 1980, pp. 1552-1558, XP002696857.

* cited by examiner

COMPOSITIONS

CROSS-REFERENCE TO RELATED APPLICATIONS

This application claims the benefit of European Application No. 12199496.6, filed on Dec. 27, 2012, and European Application No. 13184382.3, filed on Sep. 13, 2013, the disclosures of which are incorporated by reference herein in their entirety.

TECHNICAL FIELD

The present disclosure generally relates to additive compositions for use in fuel and lubricant formulations, and to fuel and lubricant formulations containing the additive compositions. It also relates to the use of certain compounds in additive compositions and in fuel and lubricant formulations, for new purposes.

BACKGROUND

This section is intended to introduce various aspects of the art, which may be associated with exemplary embodiments of the present invention. This discussion is believed to assist in providing a framework to facilitate a better understanding of particular aspects of the present invention. Accordingly, it should be understood that this section should be read in this light, and not necessarily as admissions of any prior art.

It is known to include additives in fuel and lubricant formulations, in order to modify their properties and/or performance. Such additives can include, for example, detergents; antioxidants and other stabilisers; friction modifiers and lubricity additives; combustion improvers such as cetane improvers and octane boosters; viscosity and viscosity index modifiers; antifoaming agents; dehazers; and cold flow additives. Typically such additives are used in the form of an additive package which contains one or more functionally active substances in a suitable solvent vehicle.

It is often desirable to reduce the concentrations of such additives in fuel and lubricant formulations. This may be driven by consumer preferences and/or by technical or economic considerations. In cases it may be driven by a desire to reduce side effects associated with a particular additive, or with an interaction between two or more additives which are present in a formulation.

Efforts to achieve reduced additive levels have tended to focus on providing additives with higher activities, or synergistic combinations of additives, or additives with higher stabilities which can thereby provide performance-enhancing benefits for longer periods. Attempts have also been made to control the release of additives into fuel formulations, so as to enhance their effects at a location or time point where they can be most useful: such attempts include the incorporation of additives into insoluble gels, polymers and other solid matrices (eg WO 2010/132209, WO 2010/014528, WO 2006/105025, WO 2005/123238, WO 2005/052096, WO 2005/003265, WO 2003/083017, WO 2003/018727, WO 02/00812, WO 99/40166 and U.S. Pat. No. 4,515,740); their immobilisation onto filter supports (WO 2003/018988) or ion exchange resins (US 2005/0035045); their encapsulation in lipid vesicles (WO 2000/49108) or microcapsules (JP 1210497 and WO 2003/004146); and even their delivery via dispensing containers, as described in WO 2003/018726.

Accordingly, there is still a need for alternative forms of additives which can be used at lower levels and/or which can more efficiently modify the properties and/or performance of a fuel or lubricant formulation.

SUMMARY

It has now been found that certain types of compound can be used as delivery vehicles for additives in fuel and lubricant formulations, and that these compounds may be able to improve the efficiency of the additives, in use, and thus to facilitate the use of lower additive concentrations.

According to one aspect, there is provided an additive composition for use in a fuel or lubricant formulation, the additive composition comprising (i) an active substance and (ii) a modified cyclodextrin of formula (I):

(I)

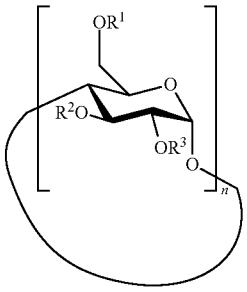

wherein n is an integer from 6 to 20, and $R^1$, $R^2$ and $R^3$ are each independently selected from hydrogen, optionally substituted alkyl, optionally substituted aryl and carbonyl, provided that $R^1$, $R^2$ and $R^3$ are not all hydrogen, the active substance being present as a guest molecule within a host molecule of the modified cyclodextrin (I), in the form of an inclusion complex.

The features and advantages of the present disclosure will be readily apparent to one having ordinary skill in the art upon a reading of the description of the embodiments that follows.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, as will occur to one having ordinary skill in the art and the benefit of this disclosure.

DETAILED DESCRIPTION

Figure 1:
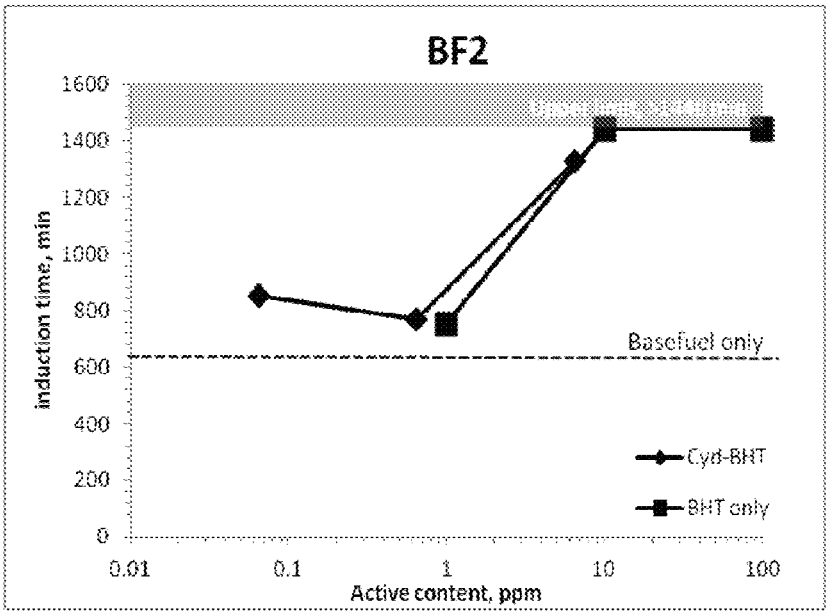
FIGS. 1 and 2 are graphs showing the results of the induction time experiments conducted in Examples 2 and 3 below.

It has been found that modified cyclodextrins of formula (I) can be highly suitable vehicles for fuel and lubricant additives. The cyclodextrin molecule naturally forms a cavity which is able to accommodate an additive molecule of an appropriate size and polarity. The capture and release of the additive "guest" molecule by the cyclodextrin "host" molecule is reversible, as it does not involve the formation of covalent or ionic bonds, relying instead on hydrogen bonding, van der Waals interactions and/or electrostatic interactions. Encapsulation of the additive in this way appears not to impair its effect on a fuel or lubricant formulation to which it is added. The encapsulation can however protect the additive, to a degree, from external influences, and can thus help to improve the stability of the additive and/or to reduce the risk of unfavourable interactions with other species present in the formulation.

The inner cavity of the cyclodextrin has solubility characteristics similar to those of ethanol, making it attractive to a wide range of both hydrophilic and hydrophobic "guest" molecules. The solubility of the cyclodextrin in its own environment, however, is dependent on the number and type of substituents it carries at the $R^1$, $R^2$ and $R^3$ positions. Because of this, the encapsulation of an additive inside a cyclodextrin host molecule can effectively modify the solubility of the additive, since the solubility of the complex as a whole will be determined by that of the cyclodextrin molecule rather than the guest.

A further potential benefit can arise because the cyclodextrin host is able to release the additive guest molecule under certain conditions, for example conditions which weaken the association between host and guest or which degrade the cavity-forming macromolecular structure of the cyclodextrin, for instance by evaporation. It can therefore be possible to select, or tailor, the modified cyclodextrin (I) so as to carry—and if necessary protect—an additive under certain conditions but to release it at a desired time or location where its effect is most needed. For example, a fuel additive such as an antioxidant or a combustion improver may be of particular use within the fuel injection and combustion regions of an engine: targeting its release to those regions can therefore improve its efficacy.

It has moreover been found that in certain cases, a modified cyclodextrin (I) can enhance the activity of a guest additive, or in cases modify the nature of its activity. This too can be of benefit in the formulation of additive-containing fuels and lubricants.

A yet further advantage to the use of molecular encapsulants, as opposed to the polymeric matrices and microcapsules proposed as additive delivery vehicles in the past, is that they are much smaller and thus less likely to cause blockages in for example fuel lines and fuel filters, or the build-up of undesired deposits in fuel- or lubricant-consuming systems.

The use of host-guest inclusion complexes as carriers for fuel and lubricant additives was proposed in 1967 in U.S. Pat. No. 3,314,884. This document mentioned cyclodextrins as potential host compounds, but did not exemplify their use. However, unmodified cyclodextrins (ie cyclodextrins of formula (I) in which $R^1$, $R^2$ and $R^3$ are all hydrogen) are crystalline materials and insoluble in organic systems, in particular in low polarity organic systems such as liquid hydrocarbons. They would not therefore be expected to be of use in typical hydrocarbon-based fuel and lubricant formulations. Indeed although cyclodextrins are widely used as vehicles for active substances in foods, beverages, fragrances, cosmetics and pharmaceuticals, in these contexts they are formulated in aqueous rather than low polarity organic systems.

Documents such as U.S. Pat. No. 5,199,959; U.S. Pat. No. 5,226,925; U.S. Pat. No. 5,482,520 and US 2001/0003231 teach the use of calixarenes as hosts for compounds which reduce nitrogen oxide levels in diesel fuels, and for compounds which improve the thermal stability of liquid oil products such as kerosenes, jet fuels and lubricating oils. Calixarenes are macrocyclic molecules which, like cyclodextrins, form cavities in which guest molecules can be captured. The chemical structure of their constituent hydrocarbon rings is, however, very different to that of the hydrophilic sugar unit from which a cyclodextrin molecule is constructed, and as a class they have potentially lower functional versatility.

The additive composition of the invention should be suitable for use in a fuel or lubricant formulation. It may be adapted for use in such a formulation, and/or intended for such use. Preferably it is suitable and/or adapted for such use.

In the present context, a fuel formulation may be any formulation, typically in liquid form, which is suitable for use as a combustible fuel. It may in particular be hydrocarbon-based, ie comprising a major proportion (for example 80% v/v or more, or 85 or 90 or 95% v/v or more) of hydrocarbon fuel components such as alkanes, cycloalkanes, alkenes and aromatic hydrocarbons. The hydrocarbon fuel components may be mineral-derived, or derived from a biological source, or synthetic. Such a formulation may contain one or more components in addition to its hydrocarbon fuel components, for example selected from oxygenates, biofuel components and fuel additives.

A fuel formulation may be suitable and/or adapted for use in any fuel-consuming system, for example an engine (more particularly an internal combustion engine), a heating appliance or a cooking appliance. It may be selected from automotive fuel formulations (for example automotive gasoline and diesel fuel formulations), aviation fuel formulations (for example aviation gasoline and jet fuel formulations), kerosene fuel formulations, marine fuel formulations (for example marine diesel formulations), and heating oil formulations. In an embodiment, it is selected from automotive fuel formulations (for example automotive gasoline and diesel fuel formulations), aviation fuel formulations (for example aviation gasoline and jet fuel formulations), kerosene fuel formulations, and marine fuel formulations (for example marine diesel formulations).

In an embodiment, the fuel formulation is an automotive fuel formulation. It may be a gasoline fuel formulation, which is suitable and/or adapted for use in a spark ignition (petrol) internal combustion engine. It may be a diesel fuel formulation, which is suitable and/or adapted for use in a compression ignition (diesel) internal combustion engine.

A lubricant formulation is a formulation which is suitable and/or adapted for use to reduce friction between moving parts in a system, for example an engine or other fuel-consuming apparatus. It will typically be in liquid form, or in a semi-liquid form such as a grease. Again it may be hydrocarbon-based, ie it may comprise a major proportion (for example 80% v/v or more, or 85 or 90 or 95% v/v or more) of hydrocarbon base oils with suitable lubricating properties. Its hydrocarbon components may be mineral-derived, biologically-derived or synthetic. Such a formulation may contain one or more components instead of or in addition to its hydrocarbon components, for example performance-enhancing lubricant additives.

A lubricant formulation may for example be an oil or grease which is suitable and/or adapted for use in an engine, turbine, transmission system, compressor or generator.

Other preferred features of the fuel or lubricant formulation may be as described below in connection with the third aspect of the invention.

In the additive composition of the invention, the cyclodextrin of formula (I) is modified so as to increase its solubility in organic (in particular hydrocarbon-based) formulations. The modified cyclodextrin (I), and the overall additive composition, are thus suitably soluble in a fuel or lubricant formulation in which they are adapted and/or intended to be used. Such a formulation will typically be of low polarity, although the inclusion of higher polarity components such as fatty acid methyl esters or alcohols may increase the polarity of the formulation relative to its base hydrocarbons. The natures of the groups $R^1$, $R^2$ and $R^3$ should be such as to impart the desired solubility characteristics to the cyclodextrin molecule, allowing the additive composition to be tailored for use in a chosen fuel or lubricant formulation.

In this way, it can be possible to modify the effective solubility of an active substance in a fuel or lubricant formulation. Once encapsulated in a cyclodextrin host molecule, an active substance molecule which would otherwise be relatively insoluble in the formulation can benefit from the greater solubility of its host.

In an embodiment of the invention, in particular where the additive composition is for use in a fuel formulation such as a gasoline or diesel fuel formulation, the modified cyclodextrin of formula (I) is an alkylated cyclodextrin. By "alkylated cyclodextrin" is meant a cyclodextrin of formula (I) in which at least one of the groups $R^1$, $R^2$ and $R^3$ is an optionally substituted (but in particular unsubstituted) alkyl group. In an embodiment, two or at least two of the groups $R^1$, $R^2$ and $R^3$ are independently selected from optionally substituted (in particular unsubstituted) alkyl groups. In an embodiment, all three of the groups $R^1$, $R^2$ and $R^3$ are independently selected from optionally substituted (in particular unsubstituted) alkyl groups.

Where an alkylated cyclodextrin is substituted with two or more alkyl groups, the two or more alkyl groups may be the same.

In an alkylated cyclodextrin, suitably any of the groups $R^1$, $R^2$ and $R^3$ which are not alkyl groups are hydrogen. Thus, the groups $R^1$, $R^2$ and $R^3$ may be independently selected from hydrogen and optionally substituted (in particular unsubstituted) alkyl. In an embodiment, $R^1$ is selected from optionally substituted (in particular unsubstituted) alkyl and $R^2$ and $R^3$ are both hydrogen. In an embodiment, $R^1$ and $R^3$ are independently selected from optionally substituted (in particular unsubstituted) alkyl and $R^2$ is hydrogen.

In general, in an alkylated cyclodextrin, the overall degree of substitution at the three positions $R^1$, $R^2$ and $R^3$ may for instance be 33% or greater, or 50% or greater, or 66% or greater. The degree of substitution at an individual position $R^1$, $R^2$ or $R^3$ may be from 0 to 100%, for example 10% or greater, or 25% or greater, or 50% or greater, or 75% or greater. In embodiments, the alkyl substituents may be randomly distributed between the positions $R^1$, $R^2$ and $R^3$.

In an alkylated cyclodextrin of formula (I), the integer n may in particular be from 6 to 8, more particularly 7.

In the context of the present disclosure, an "alkyl" group may be a straight or branched-chain alkyl group. It may contain up to 22 carbon atoms, or up to 20 or 18 or 16 or 14 or 12 carbon atoms, or in cases up to 6 or 5 or 4 or 3 carbon atoms. It may contain 1 carbon atom or more, or 2 or 3 carbon atoms or more, for example from 1 to 12 or from 1 to 10 or from 1 to 8 carbon atoms, or from 1 to 6 or from 1 to 4 or from 1 to 3 carbon atoms, or in cases from 2 to 8 or from 3 to 8 or from 4 to 8 carbon atoms. An alkyl group may for instance be selected from methyl, ethyl, propyl and butyl groups. It may be selected from methyl and butyl groups. A butyl group substituent may be an n-butyl group, or it may be a mixture of n-butyl and isobutyl groups.

In particular when the modified cyclodextrin (I) is an alkylated cyclodextrin, the alkyl group(s) may be selected from C1 to C12 alkyl groups, or from C2 to C12 or C3 to C12 alkyl groups. They may be selected from C1 to C10 alkyl groups, or from C2 to C10 or C3 to C10 or C4 to C10 alkyl groups. They may be selected from C1 to C8 alkyl groups, or from C2 to C8 alkyl groups, or from C3 to C8 or C4 to C8 alkyl groups. They may be selected from C1 to C6 alkyl groups, or from C2 to C6 alkyl groups, or from C3 to C6 or C4 to C6 alkyl groups. They may be selected from C1 to C5 alkyl groups, or from C2 to C5 alkyl groups, or from C3 to C5 alkyl groups. They may be selected from C1 to C4 alkyl groups, or from C2 to C4 alkyl groups, or from C3 to C4 alkyl groups.

In a specific embodiment, $R^1$, $R^2$ and $R^3$ are the same and are selected from C1 to C4 alkyl groups, in particular methyl.

In another specific embodiment, at least two of $R^1$, $R^2$ and $R^3$ (for example two of, such as $R^1$ and $R^3$) are selected from C1 to 12 or C1 to C10 or C1 to C8 alkyl groups, or from C2 to C10 or C2 to C8 or C2 to C6 alkyl groups, or from C2 to C10 or C2 to C8 or C2 to C6 alkyl groups. In particular, at least two of $R^1$, $R^2$ and $R^3$ (for example two of, such as $R^1$ and $R^3$) may be butyl, and the remaining group, if appropriate, may then be hydrogen. Thus, for example, the modified cyclodextrin (I) may be a heptakis(2,6-di-O-n-butyl)-cyclodextrin.

In a modified cyclodextrin of formula (I), an alkyl group may be substituted with one or more, typically one, hydroxyl groups, which may be primary, secondary or tertiary hydroxyl groups, in particular secondary. A hydroxyl-substituted alkyl group (a "hydroxyalkyl" group) may in particular be hydroxypropyl (for example 2-hydroxypropyl) or hydroxyethyl, more particularly hydroxypropyl. In an embodiment, at least one of the groups $R^1$, $R^2$ and $R^3$ is a hydroxyalkyl group. In an embodiment, $R^1$ is a hydroxyalkyl group, in particular 2-hydroxypropyl, and in this case $R^2$ and $R^3$ are suitably hydrogen.

An alkyl group may be substituted with one or more, typically one, amine groups —$NR^4R^5$, where $R^4$ and $R^5$ are each independently selected from hydrogen and optionally substituted (suitably unsubstituted) alkyl groups, in particular from hydrogen and C1 to C4 or C1 to C3 or C1 to C2 alkyl groups. An amine group —$NR^4R^5$ may in particular be —$NH_2$.

An "aryl" group is a group which contains an aromatic hydrocarbon ring, for example phenyl, benzyl, tolyl, xylyl, naphthyl or anthracyl. It may for example be a C5 to C18 aryl group, or a C6 to C18 aryl group, or a C6 to C14 or C6 to C10 or C6 to C8 aryl group. It may in particular be phenyl or benzyl, more particularly benzyl.

A "carbonyl" group is a group of the formula $R^6$—C(O)—, where $R^6$ is an optionally substituted (suitably unsubstituted) alkyl or aryl group, for example an alkyl, phenyl or benzyl group, where an alkyl group may in particular be a C1 to C4 or C1 to C3 or C1 to C2 alkyl group. A carbonyl group may in particular be acetyl or benzoyl, more particularly acetyl.

An "optionally substituted" group may be substituted with one or more, for example one or two, in particular one, substituents, which substituents may for example be selected from alkyl, more particularly C1 to C4 alkyl or C1 to C3 alkyl or C1 to C2 alkyl, for example methyl; aryl, for example phenyl; carboxylic acids and carboxylate ions, for example —$CH_2CO_2H$, —$CO_2H$ or the corresponding anions; alkoxyl, for example ethoxyl or methoxyl, in particular methoxyl; amine (for example —$NR^4R^5$) and amide groups, in particular primary amine and amide groups; and —OH. In particular, such substituents may be selected from alkyl, aryl, alkoxyl and —OH. Yet more particularly, they may be selected from alkyl groups, for example C1 to C4 or C1 to C3 or C1 to C2 alkyl groups, such as methyl.

An "optionally substituted" group may in particular be unsubstituted.

In an embodiment of the invention, the groups $R^1$, $R^2$ and $R^3$ are independently selected from hydrogen, unsubstituted alkyl (in particular unsubstituted C1 to C8 or C1 to C4 alkyl) and hydroxyalkyl (in particular C1 to C4 hydroxyalkyl, more particularly hydroxypropyl). In an embodiment, $R^1$ is selected from optionally substituted alkyl (in particular unsubstituted alkyl and hydroxyalkyl) and carbonyl, and $R^2$ and $R^3$ are both hydrogen. In an embodiment, $R^1$ is selected from optionally substituted alkyl (in particular unsubstituted alkyl and hydroxyalkyl), and $R^2$ and $R^3$ are both hydrogen.

In general, the carbon chain length of the groups $R^1$, $R^2$ and $R^3$ may be chosen to enhance solubility of the cyclodextrin (I) in a chosen fuel or lubricant formulation, longer chain groups typically leading to a greater hydrophobicity and hence a greater affinity for lower polarity, more hydrophobic organic systems. For use in more polar formulations such as high oxygenate content gasoline or diesel fuel formulations, it may be preferred for the groups $R^1$, $R^2$ and $R^3$ to be selected from shorter chain alkyl groups, in particular methyl, and/or from alkyl groups which are substituted with polar functional groups such as hydroxyl. Longer chain alkyl groups, for example butyl, may be used to render the cyclodextrin more hydrophobic.

For use in a low polarity fuel or lubricant formulation, it may be preferred for at least one, suitably two or three, of the groups $R^1$, $R^2$ and $R^3$ to be a longer chain (for example C4 or greater, or C4 to C12 or C4 to C10 or C4 to C8) alkyl group, which is suitably unsubstituted. In cases such a longer chain alkyl group may be a C12 to C22 or C12 to C18 alkyl group.

In an embodiment, in particular where the additive composition is for use in a non-polar gasoline or diesel fuel formulation or a non-polar lubricant formulation, the groups $R^1$, $R^2$ and $R^3$ may be independently selected from hydrogen and unsubstituted alkyl (in particular C1 to C8 or C4 to C8 alkyl, for example methyl or more particularly butyl). Yet more particularly, at least two of $R^1$, $R^2$ and $R^3$ (for example $R^1$ and $R^3$) may be independently selected from unsubstituted alkyl (for example C1 to C8 or C4 to C8 alkyl, in particular methyl or butyl, more particularly butyl): the two or more alkyl groups may be the same.

In an embodiment, in particular where the additive composition is for use in a moderately polar fuel or lubricant formulation, for example a formulation containing up to about 10% v/v of an oxygenate such as an alcohol or a fatty acid methyl ester (FAME), one or two of the groups $R^1$, $R^2$ and $R^3$ (for example $R^1$ and $R^3$) may be independently selected from unsubstituted alkyl (in particular C1 to C8 or C1 to C4 alkyl, for example methyl or butyl, more particularly methyl) and the remaining group(s) may be hydrogen. Thus, for example, the modified cyclodextrin (I) may be a tri-methyl cyclodextrin or a di-O-n-butyl cyclodextrin.

In an embodiment, in particular where the additive composition is for use in a more polar fuel or lubricant formulation, for example a formulation containing greater than about 5 or 10% v/v of an oxygenate such as an alcohol or a FAME (or in cases 20 or 30 or 40 or 50% v/v or more of such an oxygenate), at least one of the groups $R^1$, $R^2$ and $R^3$ may be an alkyl group (in particular a C1 to C4 alkyl group) substituted with a polar group such as hydroxyl: in this case, suitably at least $R^1$ is a hydroxyalkyl group.

In an embodiment, the modified cyclodextrin (I) is an alkylated cyclodextrin in which the alkyl group(s) are selected from unsubstituted C1 to C12 or C1 to C8 or C2 to C8 alkyl groups.

A particularly preferred alkylated cyclodextrin is substituted with two butyl groups (for example n-butyl groups, or a mixture of n-butyl and isobutyl groups) on each monomer residue: such a cyclodextrin is suitably a β-cyclodextrin. These cyclodextrins have been found to have good solubility in a range of gasoline and diesel fuels, and are expected to exhibit a good balance (HLB balance) of hydrophilic and hydrophobic characteristics.

In the modified cyclodextrin (I), the integer n may in particular be from 4 to 10, or from 5 to 9, or more particularly from 6 to 8. When n=6 the cyclodextrin is an α-cyclodextrin, which forms a frustoconical structure having an external diameter of 1.4 nm and an internal cavity diameter of 0.6 nm. When n=7 it is a β-cyclodextrin, which forms a frustoconical structure having an external diameter of 1.5 nm and an internal diameter of 0.8 nm. When n=8 it is a γ-cyclodextrin, in which the frustocone has an external diameter of 1.7 nm and an internal diameter of 1.0 nm. Thus, the value of n affects the size of the cavity in which a guest molecule can be encapsulated. It may therefore be chosen to yield a cavity of a size suitable to accommodate one or more molecules of (suitably one molecule of) a chosen active substance.

In an embodiment of the invention, the modified cyclodextrin (I) is a β-cyclodextrin (i.e., n=7).

In the context of the present disclosure, an "active substance" is a substance which is active as a fuel or lubricant additive. Such a substance is capable of performing a technical function when incorporated in a fuel or lubricant formulation: it will typically be capable of modifying a property of, and/or the performance of, the formulation.

In an embodiment, the active substance is a substance which is suitable and/or adapted for use as a fuel additive, in particular a gasoline or diesel fuel additive. In an embodiment, it is a substance which is suitable and/or adapted for use as a lubricant additive. The active substance may for example be selected from antioxidants, corrosion inhibitors, detergents and dispersant additives, antiknock additives, metal deactivators, valve-seat recession protectant compounds, viscosity and viscosity index modifiers, octane boosters, dyes and other markers, friction modifiers, lubricity additives, anti-wear additives, cetane improvers, antistatic additives, antifoaming agents, dehazers, cold flow additives, and combinations thereof. It may in particular be selected from antioxidants, combustion improvers such as octane boosters or cetane improvers, detergents, and combinations thereof. In an embodiment, it is selected from combustion improvers, detergents, and mixtures thereof.

In an embodiment, the active substance is a polar species.

In an embodiment, the active substance is an antioxidant. An antioxidant is a substance which is capable of reducing, or is intended to reduce, the rate of oxidation of a fuel or lubricant formulation to which it is added, or of a component of such a formulation. Many such additives are known and commercially available, for use in fuel and lubricant formulations: examples include phenols and aromatic amines.

In an embodiment, the active substance is an antioxidant selected from phenolic antioxidants, in particular hindered phenols such as butylated hydroxytoluene; quinones; hydroquinones; amines, in particular aromatic amines; and mixtures thereof. It may be selected from phenolic antioxidants, in particular hindered phenols; amines, in particular aromatic amines; and mixtures thereof.

In an embodiment, the antioxidant is a phenolic antioxidant, in particular a hindered phenol. It may for example be selected from 2,6-di-t-butyl-4-methylphenol (also known as 2,6-di-t-butyl-p-cresol, 3,5-di-t-butyl-4-hydroxytoluene or butylated hydroxytoluene (BHT)); 2,4-dimethyl-6-t-butylphenol; 2,6-di-t-butylphenol; and mixtures of t-butylphenols. The antioxidant may in particular be BHT.

In an embodiment, the antioxidant is an amine. It may be an aromatic amine, in particular a phenylene diamine containing one or more alkyl and/or aryl groups. It may for example be selected from N,N'-di-2-butyl-1,4-phenylenediamine; N-isopropyl-N'-phenyl-p-phenylene diamine; N-(1,3-dimethyl butyl)-N'-phenyl-p-phenylene diamine; N-(1-methylheptyl)-N'-phenyl-p-phenylene diamine; N-cyclohexyl-N'-phenyl-p-phenylene diamine; N,N'-di-sec-butyl-p-phenylene diamine; N,N'-diisopropyl-p-phenylene diamine; N,N'-diphenyl-p-phenylene diamine; N,N'-ditolyl-p-phenylene diamine; N-tolyl-N'-xylenyl-p-phenylene diamine; and mixtures thereof. In an embodiment, it is N,N-di-t-butyl-1,4-phenylenediamine.

In an embodiment, the active substance is a detergent. By "detergent" or "detergent additive" is meant an agent which can act to remove, and/or to prevent the accumulation of, deposits such as combustion-related deposits within a fuel- or lubricant-consuming system, in particular within a fuel injection system such as in or on the injector nozzles. Many such agents are surfactants, for example zwitterionic surfactants or polyisobutenyl (PIB)-based surfactants such as polyisobutenyl amines, polyisobutenyl succinimides and polyisobutenyl succinic anhydrides.

Detergent additives suitable for use in fuel formulations include those disclosed in WO 2009/50287, which is incorporated herein by reference.

Suitable detergent additives typically have at least one hydrophobic hydrocarbon radical having a number-average molecular weight (Mn) of from 85 to 20,000 and at least one polar moiety, which may include a monomeric or polymeric amine, amide or imido moiety.

In an embodiment, the active substance is a nitrogen-containing detergent, in particular an amine- or polyamine-containing detergent. In an embodiment, such a detergent contains a hydrophobic hydrocarbon radical having a number average molecular weight in the range from 300 to 5000. A nitrogen-containing detergent may be selected from the group consisting of polyalkene monoamines, polyetheramines, polyalkene Mannich amines, polyalkene succinimides, and mixtures thereof. Conveniently, a nitrogen-containing detergent may be a polyalkene monoamine.

In an embodiment, such a detergent is a polyisobutenyl (PIB) succinimide.

In an embodiment, the active substance is a combustion improver. It may for example be a cetane improver or octane booster.

In the context of the present disclosure, a cetane improver is a substance which is capable of increasing the cetane number of a fuel formulation in which it is present, whether on its own or in the form of an inclusion complex within a host molecule of the modified cyclodextrin (I). In general a cetane improver may be capable of improving the ignition properties of a diesel fuel formulation when the formulation is used in an engine or other fuel-consuming system.

Such a cetane improver is ideally suitable and/or adapted for use as a diesel fuel additive.

A cetane improver may also be known as a cetane number improver or an ignition improver. Many such additives are known and commercially available; they typically function by increasing the concentration of free radicals when a fuel begins to react in a combustion chamber of a fuel-consuming system. Examples include organic nitrates and nitrites, in particular (cyclo)alkyl nitrates such as isopropyl nitrate, 2-ethylhexyl nitrate (2-EHN) and cyclohexyl nitrate, and ethyl nitrates such as methoxyethyl nitrate; and organic (hydro)peroxides such as di-tert-butyl peroxide. Cetane improving diesel fuel additives are commercially available for instance as HITEC™ 4103 (ex Afton Chemical) and as CI-0801 and CI-0806 (ex Innospec Inc).

In an embodiment, the active substance is a cetane improver selected from organic nitrates and nitrites, in particular (cyclo)alkyl nitrates; organic (hydro)peroxides; and mixtures thereof. In an embodiment it is selected from 2-EHN, di-tert-butyl peroxide, and mixtures thereof.

In the context of the present disclosure, an octane booster is a substance which is capable of increasing the octane number of a fuel formulation in which it is present, whether on its own or in the form of an inclusion complex within a host molecule of the modified cyclodextrin (I). In general an octane booster may be capable of improving the ignition properties of a gasoline fuel formulation when the formulation is used in an engine or other fuel-consuming system.

Such an octane booster is ideally suitable and/or adapted for use as a gasoline fuel additive.

Many such additives are known and commercially available. Aromatic amines for example, in particular anilines, are known for use as octane boosters in gasoline fuels. WO 2008/073118, WO 2008/076759, WO 2010/001341 and RU 2235117 describe the use of N-alkyl anilines such as N-methyl aniline (NMA) for this purpose.

Ethers such as alkyl t-butyl ethers (for example methyl t-butyl ether (MTBE) and ethyl t-butyl ether (ETBE)) have also been included as octane boosters in gasoline fuels. U.S. Pat. No. 6,858,048; U.S. Pat. No. 5,470,358; US 2006/0225340; EP 0 948 584; WO 02/22766 and US 2008/0168706 disclose aviation gasoline formulations containing ether, ester and alcohol octane boosters.

Also known as octane boosters are species which include aromatic moieties such as phenyl or cyclopentadienyl rings, in particular phenyl rings. Such octane boosters may be entirely organic (for example toluene), or they may include metallic components such as in the aromatic octane-boosting metal complexes methylcyclopentadienyl manganese tricarbonyl (MMT), ferrocene (which comprises two cyclopentadienyl rings bound to a central $Fe^{2+}$ ion) and substituted ferrocenes such as alkyl (eg decamethyl) ferrocene. An aromatic octane booster may therefore be selected, for example, from aromatic amine octane boosters, alkyl-substituted benzenes (in particular toluene), alkyl-substituted phenols, quinoline derivatives, metal-containing aromatic octane boosters, and mixtures thereof. It may be selected from phenol derivatives and mixtures thereof. It may for example comprise an alkyl-substituted phenol such as cresol (in particular m-cresol), 4-ethylphenol or 2,4,6-trimethylphenol. An alkyl-substituted phenol may be substituted with up to 5, suitably up to 4, more suitably up to 3, alkyl groups, which may in particular be C1 to C4 alkyl groups and more particularly C1 to C2 alkyl groups. An aromatic octane booster may be selected from quinoline derivatives and mixtures thereof: it may for example comprise 1,2,3,4-tetrahydroquinoline.

Another known octane booster is iso-octane.

An aromatic amine octane booster may in particular be a species which includes an amine-substituted phenyl ring. An amine-substituted phenyl ring may be further substituted, at the nitrogen atom of the amine group and/or at one or more carbon atoms on the phenyl ring. Thus, an aromatic octane booster may be an aniline (ie aniline itself or a substituted aniline).

A substituted aniline may be substituted at a ring carbon atom and/or at the nitrogen atom, and may for example be mono- or di-substituted, in particular mono-substituted. Suitable substituents may be selected from C1 to C4 alkyl groups and phenyl, in particular methyl, ethyl and phenyl, more particularly methyl and ethyl.

Substituted anilines may therefore include alkyl-substituted anilines, in which the phenyl ring is substituted with one or more, in particular one, alkyl group (as in, for instance, 4-ethyl aniline or a toluidine such as m-toluidine); halo-substituted anilines, in which the phenyl ring is substituted with one or more, in particular one, halo group selected for instance from fluoro and chloro groups, as in 4-fluoro aniline; alkoxyl-substituted anilines, in which the phenyl ring is substituted with one or more, in particular one, alkoxyl group (as in, for instance, an anisidine such as m-anisidine); amine-substituted anilines, in which the phenyl ring is substituted with one or more, in particular one, amine group of the formula —$NR^1R^2$ in which $R^1$ and $R^2$ are independently selected from hydrogen and alkyl (for instance N,N-diethyl-p-phenylenediamine); and N-substituted anilines, in which the nitrogen atom of the amine group is substituted with one or more, in particular one, group selected from alkyl and phenyl groups (for instance N-alkyl anilines such as N-methyl aniline, and N-phenyl anilines such as diphenylamine).

In an embodiment, an aromatic octane booster is selected from aniline; m-toluidine; p-toluidine; 4-ethyl aniline; N-methyl aniline; diphenylamine; 4-fluoroaniline; m-anisidine; N,N-diethyl-p-phenylenediamine; p-cresol; m-cresol; MMT; ferrocene; 1,2,3,4-tetrahydroquinoline; 4-ethylphenol; 2,4,6-trimethylphenol; and mixtures thereof. In an embodiment, it is selected from aniline; m-toluidine; 4-ethyl aniline; diphenylamine; 4-ethylphenol; 2,4,6-trimethylphenol; MMT; ferrocene; and mixtures thereof.

It is likely to be preferred for an aromatic amine octane booster not to be a pyrrole.

In an embodiment of the invention, the active substance is an octane booster selected from species which include aromatic moieties, as described above, in particular aromatic amines and more particularly anilines; ethers, in particular dialkyl ethers and more particularly alkyl t-butyl ethers; and mixtures thereof. In an embodiment it is selected from aromatic amines, in particular anilines, and mixtures thereof.

In a further embodiment of the invention, it may be preferred for the active substance not to be a cetane improver.

An additive composition according to the invention may comprise a mixture of two or more different active substances. Not all of these need be present as guest molecules within modified cyclodextrin host molecules. Thus, the composition may comprise one or more additional active substances which are not encapsulated in modified cyclodextrins of formula (I).

The composition may comprise a mixture of two or more different modified cyclodextrins of formula (I). Not all of these need be complexed with an active substance.

The composition may comprise a solvent carrier, or mixture thereof, for the active substance and the modified cyclodextrin. Suitable such solvents are well known and commercially available. Commonly used additive solvents include hydrocarbon solvents such as alkanes, alkenes and aromatic hydrocarbons; mixtures of hydrocarbons such as in distillate fractions; and more polar solvents such as alcohols and ethers. The nature of the solvent or solvent mixture used in the additive composition (in particular its polarity) may be chosen to suit the natures and polarities of the active substance and the modified cyclodextrin, as well as of a fuel or lubricant formulation in which the additive composition is to be used, so as to optimise the stability and efficacy of the composition during use.

In an embodiment, however, the additive composition may be in solid form.

The concentration, in the additive composition, of the inclusion complex formed between the active substance and the modified cyclodextrin (I) may for example be 10 ppmw (parts per million by weight) or greater, for example 50 or 100 ppmw or greater. It may for example be up to 10,000 ppmw, or up to 5,000 ppmw, such as from 10 to 10,000 ppmw or from 100 to 5,000 ppmw. In an embodiment, the additive composition may consist essentially of (for example it may contain at least 98 or 99% w/w of) the inclusion complex, in particular when the composition is in solid form.

The molar ratio of the active substance to the modified cyclodextrin (I), in the additive composition, may for example be 1:50 or greater, or 1:25 or greater, or 1:20 or greater. This ratio may for example be up to 5:1, or up to 2:1 or 1:1, or up to 1:2 or 1:5 or 1:10, such as from 1:50 to 5:1, or from 1:50 to 2:1, or from 1:50 to 1:1, or in case from 1:50 to 1:2 or from 1:20 to 1:10, for example about 1:10.

This ratio may depend on the natures of the active substance and the modified cyclodextrin (I): it may be possible to encapsulate one or two molecules of a smaller active substance within a single cyclodextrin host molecule, for example, whilst in other cases two cyclodextrin molecules may be able to fit around a single guest molecule. A polymeric active substance may be capable of associating with more than one cyclodextrin molecule, each complexing with a discrete part of the polymer molecule.

In embodiments of the invention, a molar excess of the modified cyclodextrin (I) or of the active substance may be used to achieve a desired technical effect in a fuel or lubricant formulation to which the composition is added. For example, an excess of the active substance will provide a quantity of unencapsulated active substance (which is immediately available but may therefore be more readily lost or degraded over time), together with a quantity of encapsulated active substance (which may be released later at a desired location or time, in response to an appropriate trigger, after the unencapsulated active substance has been depleted). This can be used to prolong the effective lifetime of the additive composition prior to and/or during its use in a fuel or lubricant formulation.

An additive composition according to the invention may be prepared by mixing together the active substance and the modified cyclodextrin (I), suitably with a solvent carrier or mixture thereof, and optionally with one or more additional fuel or lubricant additives or active substances. Techniques for preparing a cyclodextrin inclusion complex, containing a guest molecule, are known to those skilled in the art: suitable examples include kneading, heating, co-precipitation, freeze-drying or lyophilisation, spray-drying, gas-liquid methods, supercritical fluid-based methods, and combinations thereof (see for example Marques, "A review on cyclodextrin encapsulation of essential oils and volatiles", *Flavour Fragr J,* 2010, 25: 313-326, in particular pages 321-322; and *Chemical Reviews* 98, 2035-2044). By way of example, the cyclodextrin (I) and the active substance may be stirred together in an appropriate solvent, with heating if necessary, in order to generate the desired host-guest complex, followed by removal of the solvent by suitable means such as filtration or spray drying. Known techniques may be used to verify complex formation, for instance nuclear magnetic resonance spectroscopy, visible or ultraviolet spectroscopy, fluorescence spectroscopy, infrared spectroscopy, differential scanning calorimetry or other thermal methods, X-ray diffraction, chromatography, mass spectrometry, optical methods, vacuum methods, or with reference to phase solubility changes (again, see Marques, as referenced above, pages 322-324).

The active substance and the modified cyclodextrin (I) may each be used in a suitable respective solvent or other carrier. Thus, the additive composition of the invention may be prepared by combining a first premix containing the active substance, optionally with one or more carriers, and a second premix containing the modified cyclodextrin (I), optionally with one or more carriers. A premix comprising a modified cyclodextrin of formula (I), in particular together with one or more carriers which are suitable for use in a fuel or lubricant formulation (eg a gasoline or diesel fuel formulation), may therefore constitute an essential element for the carrying out of embodiments provided herein.

A second aspect of the invention can therefore provide a premix for use in an additive composition according to the first aspect, the premix comprising a modified cyclodextrin of formula (I) and one or more carriers which are suitable for use in a fuel or lubricant formulation. Such carriers may in particular be liquid carriers. They may conveniently be of low polarity, and/or hydrophobic, and/or non-aqueous, to render them suitable for use in fuel or lubricant formulations.

Such a premix may for example be combined with an active sub stance-containing additive package in order to form a composition according to the first aspect of the invention.

A modified cyclodextrin of formula (I) may be obtained from an unmodified cyclodextrin by standard chemical techniques, as would be well known to the synthetic chemist. Unmodified cyclodextrins are widely available commercially; they are typically produced from starch by enzymatic conversion. Thus, a cyclodextrin (I) may be derived from a biological source, which can be advantageous as there is increasing demand for fuel and lubricant formulations, in particular fuel formulations, to include higher concentrations of biologically-derived components.

The active substance and the modified cyclodextrin (I), and in particular the value for the integer n and the natures of the groups $R^1$, $R^2$ and $R^3$, are suitably chosen such that they naturally associate with one another, to form the desired host-guest inclusion complex, under the desired conditions of preparation, storage, transport and/or use of the composition, in particular during its use in a fuel or lubricant formulation.

In an embodiment of the invention, the modified cyclodextrin (I) may be tailored for use under specific conditions and/or with a specific active substance. More particularly, it may be tailored so as to release the active substance guest molecule under specific conditions. In this way, the composition of the invention may be used to control—including to target—delivery of the active substance in a fuel or lubricant formulation.

By way of example, the active substance may be wholly or partially released from the cyclodextrin inclusion complex when the composition is exposed to a temperature within a specific range, for example a temperature range to which a fuel or lubricant formulation is exposed during a critical period of use. In this way, the active substance can be protected and stabilised by the cyclodextrin—or in the case of an additive which presents a health or safety hazard, can be rendered safer by its encapsulation—until the point when its chemical effect is most needed, for example in the combustion region of a fuel-consuming system. Instead or in addition, the active substance may be wholly or partially released from the inclusion complex when the composition is exposed to a pressure within a specific range, or to a shear force within a specific range.

The active substance and the modified cyclodextrin (I) may be chosen such that during use, the active substance is released at a desired rate from the cyclodextrin inclusion complex, thus potentially prolonging the efficacy of the active substance in the additive composition or in a fuel or lubricant formulation.

In an embodiment of the invention, the active substance and the modified cyclodextrin (I) are such that the active substance is released from the cyclodextrin inclusion complex when the additive composition is subjected to a temperature above or below (in particular above) a predetermined value, for example a temperature within the operating range of an engine or other fuel- or lubricant-consuming system in which the additive composition is, or is intended to be, used. The active substance may for example be released when the composition is exposed to a temperature of 50° C. or greater, or of 60° C. or greater, or of 100 or 150° C. or greater, or of 200 or 220° C. or greater.

Cyclodextrins are thermally degradable. The rate and onset of their thermal degradation varies depending on their substituents and the value of n in the formula (I) above. By way of example, trimethyl-substituted β-cyclodextrin has been found to be generally stable at 50-150° C. (no significant degradation over 200 minutes); to degrade at approximately 0.01 mg/min at 200° C.; and at 250° C. to exhibit a faster degradation rate of approximately 1 mg/min. The molecule would therefore be suitable as a host for a fuel additive: the additive would remain encapsulated under storage conditions (fuel tank temperatures, for example, are typically ~50° C.); be slowly released under warmer conditions (for example the fuel line of a common rail diesel system is likely to be at ~150° C.); be more quickly released under hot conditions (eg post-injection, before combustion); and be almost immediately released under very hot conditions, at the point of combustion.

In an embodiment, the active substance and the modified cyclodextrin (I) are such that the active substance is released from the cyclodextrin inclusion complex when the composition is subjected to a pressure above a predetermined value, for example a pressure within the operating range of an engine or other fuel- or lubricant-consuming system in which the additive composition is, or is intended to be, used. The active substance may for example be released when the composition is exposed to a pressure of greater than 1 atmosphere, or of 100 or 200 atmospheres or greater, or of 500 or 1,000 or 1,500 or 2,000 atmospheres or greater, for example of up to 2,200 atmospheres.

The active substance and the modified cyclodextrin (I) may be such that the active substance is released when the composition is subjected to a pressure below a predetermined value, for example a pressure below 1 atmosphere.

In an embodiment, the active substance and the modified cyclodextrin (I) are such that the active substance is released from the cyclodextrin inclusion complex when the additive composition is exposed to another species, for example a species which can compete with the active substance to enter the cyclodextrin cavity.

Thus, the nature of the cyclodextrin (I), and in particular of its modifying groups $R^1$, $R^2$ and $R^3$, may be tailored to suit not only the environment in which, and the active substance with which, it is intended to be used, but also the conditions under which it associates with and dissociates from the active substance, and/or under which it otherwise releases a guest molecule, for instance by itself degrading at the molecular or macromolecular level.

According to a third aspect, there is provided a fuel or lubricant formulation comprising an additive composition in accordance with the first aspect.

In an embodiment, the fuel or lubricant formulation is a fuel formulation, in particular a gasoline or diesel fuel formulation. It may for example be an automotive gasoline fuel formulation, an aviation gasoline fuel formulation, an aviation jet fuel formulation, an automotive diesel fuel formulation, an industrial gas oil formulation, a heating oil formulation or a marine diesel fuel formulation. It may in particular be an automotive fuel formulation such as an automotive gasoline or diesel fuel formulation.

In an embodiment, the formulation is a gasoline fuel formulation (which may optionally contain an oxygenate such as an alcohol, in particular ethanol) or a diesel fuel formulation (which may optionally contain an oxygenate or biodiesel component such as a FAME or a hydrogenated vegetable oil, in particular a FAME). The concentrations of oxygenate or biodiesel components, where present, may be as described below.

In a specific embodiment, the fuel formulation is a diesel fuel formulation, in particular when the active substance is a cetane improver (when the modified cyclodextrin (I) may be used to enhance the solubility and/or cetane-boosting activity of the substance, and/or to reduce or target its volatility) or a detergent (when the modified cyclodextrin may be used to enhance the solubility of the substance).

In an embodiment, the fuel formulation is a gasoline fuel formulation, in particular an automotive gasoline fuel formulation. Apart from the additive composition of the invention, such a formulation may be conventional in terms of its constituents and their relative concentrations. It may for example comprise a gasoline base fuel. A gasoline base fuel is a liquid hydrocarbon distillate fuel component, or mixture of such components, containing hydrocarbons which boil in the range from 0 to 250° C. (ASTM D86 or EN ISO 3405) or from 20 or 25 to 200 or 230° C. The optimal boiling ranges and distillation curves for such base fuels will typically vary according to the conditions of their intended use, for example the climate, the season and any applicable local regulatory standards or consumer preferences.

The hydrocarbon fuel component(s) in the gasoline base fuel may be obtained from any suitable source. They may for example be derived from petroleum, coal tar, natural gas or wood, in particular petroleum. Alternatively they may be synthetic products, for instance from a Fischer-Tropsch condensation process. Conveniently they may be derived in any known manner from straight-run gasoline, synthetically-produced aromatic hydrocarbon mixtures, thermally or catalytically cracked hydrocarbons, hydrocracked petroleum fractions, catalytically reformed hydrocarbons or mixtures of these. Typically, gasoline base fuels comprise components selected from one or more of the following groups: saturated hydrocarbons, olefinic hydrocarbons, aromatic hydrocarbons and oxygenated hydrocarbons.

A gasoline base fuel will typically have a research octane number (RON) (ASTM D2699 or EN ISO 5164) of 80 or greater, or of 85 or 90 or 93 or 94 or 95 or 98 or greater, for example from 80 to 110 or from 85 to 115 or from 90 to 105 or from 93 to 102 or from 94 to 100. It will typically have a motor octane number (MON) (ASTM D2700 or EN ISO 5163) of 70 or greater, or of 75 or 80 or 84 or 85 or greater, for example from 70 to 110 or from 75 to 105 or from 84 to 95.

A gasoline base fuel will typically have an E70 value of 10% v/v or greater, or of 14 or 15 or 20% v/v or greater. Its E70 value might typically be up to 55% v/v, or up to 50% v/v. It will typically have an E100 value of 35% v/v or greater, or of 40 or 45% v/v or greater. Its E100 value might typically be up to 75% v/v, or up to 72 or 70% v/v. The E70 value for a fuel is the volume percentage of the fuel which has been distilled at 70° C., whilst the E100 value is the volume percentage of the fuel which has been distilled at 100° C. Both E70 and E100 values can be measured using the standard test method EN ISO 3405.

A gasoline base fuel might typically have a density from 0.720 to 0.775 kg/m$^3$ at 15° C. (ASTM D4052 or EN ISO 3675).

A gasoline base fuel may be or include one or more biofuel components, which are derived from biological sources. It may be or include one or more oxygenates such as alcohols, ethers, esters, carboxylic acids and their derivatives, aldehydes, ketones, and mixtures thereof, in particular from alcohols, ethers (for example dialkyl ethers such as alkyl t-butyl ethers), and mixtures thereof. Such oxygenates are suitably derived from biological sources.

The concentration of the base fuel, if present in a gasoline fuel formulation according to the invention, may be 50% v/v or greater. It may for example be 60 or 70 or 80% v/v or greater, or 85 or 90 or 95 or 98% v/v or greater. The base fuel concentration may be up to 99.99% v/v, or up to 99.95% v/v, or up to 99.9 or 99.5% v/v. It may be up to 99% v/v, for example up to 98 or 95 or 90% v/v, or in cases up to 85 or 80% v/v.

A gasoline fuel formulation according to the third aspect of the invention may comprise an alcohol. Suitable alcohols include C1 to C5 saturated or unsaturated alcohols, in particular C1 to C4 aliphatic alcohols such as methanol, ethanol, isopropanol and butanol, and certain bio-derived alcohols. The alcohol may in particular be a C1 to C3 aliphatic alcohol, for example selected from methanol, ethanol and mixtures thereof. In an embodiment, it is ethanol.

Where the fuel formulation comprises an alcohol, its concentration may be 0.5% v/v or greater based on the overall formulation. This concentration may be 1 or 2.5 or 5% v/v or greater, or 7.5 or 10% v/v or greater, or in cases 15 or 20 or 25% v/v or greater. It may be up to 30% v/v, or up to 25 or 20% v/v, or up to 15 or 12.5 or 10% v/v, or in cases up to 7.5 or 5% v/v. It may for example be from 1 to 20% v/v, or from 5 to 15% v/v. In cases it may be up to 40 or 50 or 60 or 70 or 80 or 85 or even 90% v/v, or in cases up to 95 or 98 or 99 or 99.5% v/v. The alcohol concentration may be up to 100% v/v (in other words, the fuel formulation may consist of an alcohol or mixture of alcohols, optionally with one or more fuel additives).

A gasoline fuel formulation according to the invention may comprise one or more additional fuel components. In an embodiment, it may comprise one or more additional biofuel components. Such additional fuel components may have boiling points within the normal gasoline boiling range, and in the case of biofuel components will have been derived—whether directly or indirectly—from biological sources.

A gasoline fuel formulation according to the third aspect of the invention may be suitable and/or adapted for use in a spark ignition (petrol) internal combustion engine. It may in particular be suitable and/or adapted for use as an automotive gasoline fuel.

The MON of such a gasoline fuel formulation is suitably 70 or greater, or 75 or 80 or greater. It may be 84 or 85 or greater. The MON may for example be from 70 to 110 or from 75 to 105 or from 84 to 95. The RON of such a gasoline fuel formulation is suitably 80 or greater. It may be 85 or 90 or 93 or 94 or 95 or 98 or greater. The RON may for example be from 80 to 110 or from 85 to 115 or from 90 to 105 or from 93 to 102 or from 94 to 100.

The formulation will suitably comply with applicable current standard gasoline fuel specification(s) such as for example EN 228 in the European Union or ASTM D4814-08b in the USA. By way of example, the overall formulation may have a density from 0.720 to 0.775 kg/m$^3$ at 15° C. (ASTM D4052 or EN ISO 3675); a final boiling point (ASTM D86 or EN ISO 3405) of 210° C. or less; a RON (ASTM D2699 or EN ISO 5164) of 95.0 or greater; a MON (ASTM D2700 or EN ISO 5163) of 85.0 or greater; an olefinic hydrocarbon content of from 0 to 20% v/v (ASTM D1319); and/or an oxygen content of from 0 to 5% w/w (EN 1601). It may have an E70 value of from 20 to 50% v/v, and/or an E100 value of from 46 to 71% v/v. Relevant specifications may however differ from country to country, from season to season and from year to year, and may depend on the intended use of the formulation. Moreover a formulation according to the invention may contain fuel components with properties outside of these ranges, since the properties of an overall blend may differ, often significantly, from those of its individual constituents.

A gasoline fuel formulation according to the invention suitably has a low total lead content, such as at most 0.005 g/l. In an embodiment it is lead free ("unleaded"), ie it has no lead compounds in it.

Such a formulation may comprise, in addition to the additive composition of the first aspect of the invention, one or more fuel or refinery additives. Many such additives are known and commercially available. They may be present in a base fuel, or may be added to the formulation at any point during its preparation. Non-limiting examples of suitable types of fuel additives that can be included in a gasoline base fuel or gasoline fuel formulation include antioxidants, corrosion inhibitors, detergents, dehazers, antiknock additives, metal deactivators, valve-seat recession protectant compounds, viscosity control additives, octane boosters, dyes, markers, friction modifiers, and combinations thereof, as well as solvents, diluents and carriers therefor. Examples of suitable such additives are described generally in U.S. Pat. No. 5,855,629. The additives may be included in the fuel formulation at a concentration of up to 1,500 ppmw, or up to 1,000 or 500 or 300 ppmw, for example from 50 to 1,500 ppmw or from 50 to 1,000 ppmw or from 50 to 500 ppmw or from 50 to 300 ppmw.

In an alternative embodiment of the third aspect of the invention, the fuel formulation is a diesel fuel formulation, in particular an automotive diesel fuel formulation. Apart from the additive composition of the invention, such a formulation may be conventional in terms of its constituents and their relative concentrations. It may for example comprise a diesel base fuel.

A diesel base fuel may be any fuel component, or mixture thereof, which is suitable and/or adapted for combustion within a compression ignition (diesel) engine. It will typically be a liquid hydrocarbon middle distillate fuel, more typically a gas oil. It may be petroleum-derived. It may be or contain a kerosene fuel component. It may be or contain a synthetic fuel component, for instance a product of a Fischer-Tropsch condensation process. It may be or contain a fuel component derived from a biological source, for example a hydrogenated bio-derived oil (in particular a hydrogenated vegetable oil, HVO) or mixture thereof. It may be or contain an oxygenate such as a fatty acid alkyl ester, in particular a fatty acid methyl ester (FAME) such as rapeseed methyl ester (RME) or palm oil methyl ester (POME).

A diesel base fuel will typically boil in the range from 150 or 180 to 370° C. (ASTM D86 or EN ISO 3405). It will suitably have a measured cetane number (ASTM D613) of from 40 to 70 or from 40 to 65 or from 51 to 65 or 70.

A diesel fuel formulation according to the third aspect of the invention may comprise a diesel base fuel at a concentration of 50% v/v or greater, or 60 or 70 or 80% v/v or greater, or 85 or 90 or 95 or 98% v/v or greater. The base fuel concentration may be up to 99.99% v/v, or up to 99.95% v/v, or up to 99.9 or 99.5% v/v. It may be up to 99% v/v, for example up to 98 or 95 or 90% v/v, or in cases up to 85 or 80% v/v.

Where the diesel fuel formulation comprises an oxygenate or biodiesel component such as a FAME, its concentration may be 1% v/v or greater, or 2 or 5% v/v or greater, based on the overall formulation, or in cases 7 or 10 or 20 or 30% v/v or greater. The FAME concentration may be up to 100% v/v (in other words, the diesel fuel formulation may consist of a FAME or mixture of FAMEs, optionally with one or more diesel fuel additives), or up to 99 or 98 or 95% v/v, or up to 90 or 80 or 70 or 60 or 50% v/v, or in cases up to 40 or 30 or 20 or 10% v/v, for example from 1 to 40% v/v.

In an embodiment of the invention, however, it may be preferred for the diesel fuel formulation to contain no, or only a low concentration of (for example 5% v/v or less, or 2% v/v or less, or 1 or 0.5% v/v or less of), oxygenate components, or at least of FAMEs such as POME. This may in particular be the case where the active substance is an antioxidant.

A diesel fuel formulation according to the invention will suitably comply with applicable current standard diesel fuel specification(s) such as for example EN 590 (for Europe) or ASTM D975 (for the USA). By way of example, the overall formulation may have a density from 820 to 845 kg/m$^3$ at 15° C. (ASTM D4052 or EN ISO 3675); a T95 boiling point (ASTM D86 or EN ISO 3405) of 360° C. or less; a measured cetane number (ASTM D613) of 40 or greater, ideally of 51 or greater; a kinematic viscosity at 40° C. (VK40) (ASTM D445 or EN ISO 3104) from 2 to 4.5 centistokes (mm$^2$/s); a flash point (ASTM D93 or EN ISO 2719) of 55° C. or greater; a sulphur content (ASTM D2622 or EN ISO 20846) of 50 mg/kg or less; a cloud point (IP 219) of less than −10° C.; and/or a polycyclic aromatic hydrocarbons (PAH) content (EN 12916) of less than 11% w/w.

Relevant specifications may however differ from country to country, from season to season and from year to year, and may depend on the intended use of the formulation. Moreover a formulation according to the invention may contain individual fuel components with properties outside of these ranges.

A diesel fuel formulation according to the third aspect of the invention may comprise, in addition to the additive composition of the first aspect, one or more fuel or refinery additives. Many such additives are known and commercially available. They may be present in a base fuel, or may be added to the formulation at any point during its preparation. Non-limiting examples of suitable types of fuel additives that can be included in a diesel base fuel or diesel fuel formulation include cetane improvers, antistatic additives, lubricity additives, cold flow additives, and combinations thereof, as well as solvents, diluents and carriers therefor. Such additives may be included in the fuel formulation at a concentration of up to 4,000 ppmw (parts per million by weight), or up to 3,000 or 2,000 or 1,000 or 500 or 300 ppmw, for example from 50 to 4,000 ppmw or from 50 to 1,500 ppmw or from 50 to 1,000 ppmw or from 50 to 500 ppmw or from 50 to 300 ppmw.

In an embodiment, it may be preferred for a diesel fuel formulation according to the invention not to contain any cetane improvers which are present in the form of inclusion complexes within modified cyclodextrins of formula (I).

A diesel fuel formulation according to the invention may be suitable and/or adapted for use in a compression ignition (diesel) internal combustion engine. It may in particular be suitable and/or adapted for use as an automotive diesel fuel. In further embodiments it may be suitable and/or adapted for use as an industrial gas oil, or as a heating oil, or as a marine diesel fuel.

In a further alternative embodiment of the third aspect of the invention, the fuel or lubricant formulation is a lubricant formulation. Such a formulation may be suitable and/or adapted for use within a fuel-consuming system such as a combustion engine, or a part thereof, or within apparatus (for example a vehicle) which is driven by a fuel-consuming system.

Apart from the additive composition of the first aspect of the invention, a lubricant formulation according to the third aspect may be otherwise conventional in terms of its constituents and their relative concentrations. It may for example comprise a base oil or mixture thereof. Such a base oil may comprise any mineral oil, any synthetic oil, or any mixture thereof; it may have a VK40 of up to 600 cST.

Base oils of mineral origin may include those produced by solvent refining or hydro-processing. Mineral oils that may conveniently be used in a lubricant formulation according to the invention include paraffinic oils, naphthenic oils, normal paraffins, and mixtures thereof, for example those produced by refining lubricating oil cuts obtained by low-pressure distillation of atmospheric residual oils, which may in turn be obtained by atmospheric distillation of crude oil. Examples of such mineral oils include those sold by member companies of the Royal Dutch/Shell Group under the designations "HVI", "MVIN" and "HMVIP".

Synthetic base oils include polyolefins such as poly-α-olefins, co-oligomers of ethylene and α-olefins and polybutenes, poly(alkylene glycol)s such as poly(ethylene glycol) and poly(propylene glycol), diesters such as di-2-ethylhexyl sebacate and di-2-ethylhexyl adipate, polyol esters such as trimethylolpropane esters and pentaerythritol esters, perfluoroalkyl ethers, silicone oils, polyphenyl ethers, and mixtures thereof.

A synthetic base oil, or other hydrocarbon component of a lubricant formulation according to the invention, may comprise a product from a Fischer-Tropsch condensation process.

A base oil may be of the type manufactured by the hydroisomerisation of wax, such as those sold by member companies of the Royal Dutch/Shell Group under the designation "XHVI".

A lubricant formulation according to the invention may contain one or more conventional lubricant additives, for instance selected from ashless dispersants, metal or overbased metal detergent additives, anti-wear additives, viscosity index improvers, antioxidants, rust inhibitors, pour point depressants, friction reducing additives, and combinations thereof.

The lubricant formulation may be an oil or a grease. It may be suitable and/or adapted for use in an engine, turbine, transmission system, compressor or generator. It may comprise a major proportion of (for example 80% v/v or more of, or 90 or 95 or 98% v/v or more of) hydrocarbon components.

In accordance with the third aspect of the invention, the concentration of the additive composition in the fuel formulation may for example be 50 ppmw or greater, or 100 or 250 or 500 ppmw or greater. Its concentration may for example be up to 10,000 ppmw, or up to 5,000 or 4,000 or 3,000 or 2,000 or 1,500 ppmw, such as from 100 to 4,000 ppmw or in cases from 500 to 1,500 ppmw. These concentrations relate to the concentration of the active substance-cyclodextrin inclusion complex in the fuel formulation, irrespective of any solvent carriers or other species which are present, with the inclusion complex, in the additive composition.

The concentration of the additive composition in a lubricant formulation according to the third aspect of the invention may for example be 50 ppmw or greater, or 100 ppmw or 500 ppmw or greater. Its concentration may for example be up to 50,000 ppmw, or up to 20,000 or 10,000 or 5,000 ppmw, such as from 500 to 50,000 ppmw. Again, these concentrations relate to the concentration of the active substance-cyclodextrin inclusion complex in the lubricant formulation, irrespective of any solvent carriers or other species which are present in the additive composition.

The concentration of the additive composition may be chosen such that the concentration of the active substance in the overall fuel or lubricant formulation is for example 5 ppmw or greater, or 10 ppmw or greater, or 25 or 50 ppmw or greater. This concentration may for example be up to 1,000 ppmw, or up to 500 ppmw, or up to 300 or 200 or 150 ppmw, such as from 50 to 150 ppmw.

In a fuel or lubricant formulation according to the third aspect of the invention, preferred features of the additive composition (for example the natures and concentrations of the modified cyclodextrin (I) and the active substance) may be as described above in connection with the first aspect of the invention. In particular, the modified cyclodextrin (I) may be an alkylated cyclodextrin of the type defined above. The active substance may in particular be selected from detergents, combustion improvers, antioxidants, and mixtures thereof; or from detergents, combustion improvers, and mixtures thereof; or from combustion improvers, antioxidants, and mixtures thereof.

According to a fourth aspect, the present disclosure provides a method for preparing a fuel or lubricant formulation, the method comprising mixing together an additive composition according to the first aspect, and one or more fuel or lubricant components (for example base fuels or base oils), optionally with one or more additional fuel or lubricant additives. Preferred features of the additive composition, and of the fuel or lubricant component(s) and additive(s) with which it is mixed, may be as described above in connection with the first to the third aspects of the invention.

The additive composition may be mixed with the other components of the fuel or lubricant formulation at any suitable time prior to use of the formulation, for example at the refinery or at a distribution or dispensing point downstream of the refinery, in particular at a distribution point within a refinery or fuel depot. Because the cyclodextrin host molecule can help to stabilise the encapsulated active substance, and to protect it from external influences such as heat, light, oxygen and other potential reactants, the invention can allow greater flexibility as to when the additive composition can be incorporated into the fuel or lubricant formulation, with respect to the timings of its storage, transportation and use.

In an embodiment, the method of the fourth aspect of the invention involves preparing the additive composition, for example using a premix according to the second aspect, prior to mixing it with the one or more fuel or lubricant components. In an embodiment, the method of the fourth aspect involves mixing a premix according to the second aspect of the invention with one or more fuel or lubricant components. The resultant fuel or lubricant formulation, containing a premix according to the second aspect of the invention, may constitute an essential element for carrying out the third or the fourth aspect of the invention, and may therefore itself constitute a further aspect of the invention.

In an embodiment, the modified cyclodextrin (I) may be mixed with the one or more fuel or lubricant components separately from the active substance. It may for example be added to a mixture of fuel or lubricant components which already contains the active substance; or it may be added to a mixture of fuel or lubricant components prior to addition of the active substance.

In accordance with a fifth aspect of the invention, there is provided a method of operating a fuel- or lubricant-consuming system, and/or apparatus (for example a vehicle, or a heating appliance) which is driven by such a system, the method comprising introducing into the system an additive composition according to the first aspect of the invention, or a fuel or lubricant formulation according to the third aspect. This method may for example comprise introducing the additive composition or the formulation into a combustion chamber of a fuel- or lubricant-consuming system. The system may for example be an internal combustion engine. It may be a spark-ignition (petrol) engine. It may be a compression-ignition (diesel) engine.

A sixth aspect of the invention provides the use of a modified cyclodextrin of formula (I) above as a vehicle for an active substance in an additive composition or in a fuel or lubricant formulation. The fuel or lubricant formulation may be a gasoline or diesel fuel formulation.

As described above, encapsulation of an active substance in a modified cyclodextrin (I) can have a number of beneficial effects within a fuel or lubricant formulation. Firstly, it can help protect the active substance from external influences such as heat, light, oxygen and other species within the formulation with which the active substance might otherwise interact. Thus, it can reduce the extent to which the active substance can become involved in undesirable chemical processes. Secondly, the cyclodextrin can help lower the volatility of the encapsulated active substance. In these and potentially other ways, it can improve the stability of the active substance, as well as of other species in the formulation which might be compromised by interaction with the active substance.

In cases, the cyclodextrin can aid solubilisation of the active substance in the fuel or lubricant formulation, due to the inherent solubility of the cyclodextrin itself, the host molecule effectively imparting its own solubility to the encapsulated guest molecule.

Such effects can effectively increase the activity of the substance, for example by increasing its availability in a desired active form, and/or by prolonging its lifetime so that more of it is available at a given time during its use. Thus, the invention can make possible, as described below in connection with the ninth aspect of the invention, the use of a lower active substance concentration in a fuel or lubricant formulation.

In cases, it has been found that encapsulation in a modified cyclodextrin (I) can modify the nature of the effect which an active substance has on the properties and/or performance of a fuel or lubricant formulation, whether by the above described mechanisms or through some other, less well understood, interactions between the active substance and the host molecule. This can make it possible to use lower concentrations of other active substances in fuel or lubricant formulations.

Accordingly, a seventh aspect of the invention provides the use of a modified cyclodextrin of formula (I) above in an additive composition or in a fuel or lubricant formulation, in combination with an active substance, for one or more of the following purposes:

i. modifying (in particular increasing) the solubility of the active substance in the composition or formulation;

ii. modifying (in particular increasing, or changing the nature of) the activity of the active substance in the composition or formulation;

iii. modifying (in particular increasing) the stability of the active substance in the composition or formulation;

iv. modifying (in particular reducing) the volatility of the active substance in the composition or formulation; and v. protecting the active substance, at least partially, from an external influence to which it may be exposed in the composition or formulation, for example heat, light, oxygen, or another species which is present in the composition or formulation.

In an embodiment of this seventh aspect of the invention, the modified cyclodextrin (I) is used for at least purpose (i), or for at least purposes (i) and (ii). In an embodiment, it is used for at least purpose (iii), or for at least purposes (iii) and (iv), or for at least purposes (iii) and (v), or for at least purposes (iii) and (iv) and (v). In an embodiment, it is used for at least purpose (v), or for at least purpose (iv).

It has also been found that a modified cyclodextrin (I) can be used to target, or otherwise control, delivery of an active substance which it encapsulates as a guest molecule. The active substance is released from the cyclodextrin host molecule only under certain conditions, for example conditions which cause dissociation of the host-guest complex, replacement of the active substance by another, competitor guest molecule, or degradation of the cyclodextrin host molecule or its macrocyclic structure (for example by evaporation or chemical degradation). Outside of the release conditions, the cyclodextrin can retain the active substance and protect it from external influences. Under the release conditions, the active substance can leave the cyclodextrin cavity and be available for reaction elsewhere. Thus, as described above, delivery of the active substance can be targeted to a specific set of conditions, such as a specific temperature or pressure range, or a specific applied force such as a shear force, or the introduction of another species such as a competitor guest molecule. It is possible to tailor the modified cyclodextrin (I) so as to achieve, with a chosen active substance, an inclusion complex which dissociates under a desired condition or set of conditions. This aspect of the invention may be of value in targeting delivery of an active substance to a region within a fuel- or lubricant-consuming system, and/or to a period during use of a fuel or lubricant formulation, at which the active substance is likely to be of most use, for example within a fuel injection system or a combustion chamber. Instead or in addition, the invention may be used to target delivery of an active substance to a specific environment, for example a specific climate or a specific set of operating conditions within a fuel- or lubricant-consuming system. Prior to delivery, for instance during storage and transportation, the active substance can be protected from potentially damaging external influences.

Thus, an eighth aspect of the invention provides the use of a modified cyclodextrin of formula (I) in an additive composition or in a fuel or lubricant formulation, in combination with an active substance, for the purpose of controlling delivery of the active substance within or from the composition or formulation.

In the context of this eighth aspect of the invention, "controlling" delivery of the active substance may involve modifying the time, location and/or rate of delivery of the active substance. It may involve modifying the rate at which the active substance is delivered into or from the additive composition or the fuel or lubricant formulation, for instance so as to provide sustained release over a period of time.

Controlling delivery of the active substance may involve targeting its delivery to a specific time or location or condition (for instance of temperature, pressure and/or shear). It may involve modifying the rate of delivery of the active substance; modifying the time or location at which, or the conditions under which, it is delivered; modifying the amount or proportion of it which reaches a target location, or the amount or proportion which reaches a target location within a specific time period; and/or targeting the delivery more accurately to a specific time or location. It may involve modifying (in particular enhancing) the efficacy or the perceived efficacy of the active substance at a target time or location, which may involve modifying (especially increasing) the speed and/or magnitude and/or duration and/or locus of the effect (for example an antioxidant effect) which the active substance has on a fuel or lubricant formulation at a target time or location, or increasing control over the speed, magnitude, timing, duration or locus of the effect. The invention may be used to achieve any degree of modification of such parameters.

In the present context, references to the "delivery" of an active substance are to making it available in a form in which it can modify the properties and/or performance of a fuel or lubricant formulation in which it is present. Typically, "delivery" will involve release of the active substance from the cyclodextrin inclusion complex.

In an embodiment, the modified cyclodextrin (I) is used to target delivery of the active substance to a specific location within a fuel- or lubricant-consuming system, in particular to a fuel injection or fuel combustion region. It may be used to target delivery of the active substance to a specific time point, in particular a fuel injection or fuel combustion event within a fuel- or lubricant-consuming system. It may be used to prevent or inhibit release of the active substance at a specific location or during a specific time period, for example during storage and/or transportation: this may be of use if the substance carries health or safety risks.

For example, in a modern diesel engine with common rail technology, fuel from the tank is subjected to high temperatures and pressures before it reaches the fuel injector. Only some of the thus-exposed fuel is injected and the remainder is returned to the fuel tank where, having been subjected to temperature and/or pressure changes, it may be more susceptible to degradation. Embodiments provided herein may be used to target delivery of an additive to a fuel combustion region, whilst protecting it from temperature or pressure changes upstream of the combustion region and from the resultant degradation risks.

The modified cyclodextrin (I) may be used to target release of an active substance to coincide with the presence of another species in a fuel- or lubricant-consuming system. For example, it could be used to target release of an antioxidant in the presence of a polar component such as a FAME.

Use of a modified cyclodextrin (I) in accordance with the eighth aspect of the invention may involve introducing the additive composition, or the fuel or lubricant formulation, into a fuel- or lubricant-consuming system (for example an engine), and subsequently subjecting the composition or formulation, within the system, to a condition which induces at least partial release of the active substance from an inclusion complex which it forms with the cyclodextrin. The condition may for example be a temperature or pressure within a predetermined range, or a shear force within a predetermined range, or the presence of another species which can induce active substance release.

Thus, the eighth aspect of the invention may comprise, or form part of, a method for delivering an active substance to a fuel- or lubricant-consuming system, which method comprises the above described introduction and release-inducing steps.

The seventh and eighth aspects of the invention may be used to achieve any degree of modification of relevant parameters such as active substance solubility, stability, activity or delivery rate.

Because the invention may be used to improve the activity, availability, solubility or stability of the active substance, or to target its activity or availability, it can in turn make possible the use of a lower concentration of the active substance, without detriment to the overall effect of the substance on a fuel or lubricant formulation to which it is added. Instead or in addition, the invention can make possible the use of lower concentrations of other additives which might otherwise be necessary in order to achieve a desired effect on the fuel or lubricant formulation. This can in turn reduce the cost and complexity of preparing the formulation, and/or can provide greater versatility in fuel or lubricant formulation practices.

Thus, according to a ninth aspect, the invention provides the use of a modified cyclodextrin of formula (I) above in an additive composition or in a fuel or lubricant formulation, in combination with an active substance, for the purpose of reducing the concentration of an additive present in the composition or formulation. In an embodiment, the modified cyclodextrin (I) is used for the purpose of reducing the concentration of the active substance. In an embodiment, it is used for the purpose of reducing the concentration of another fuel or lubricant additive. In an embodiment, it is used for the purpose of reducing the concentration of an antioxidant. In an embodiment, it is used for the purpose of reducing the concentration of a combustion improver, for example a cetane improver or octane booster. In a further embodiment, however, it may be used for the purpose of reducing the concentration of an additive other than a cetane improver.

In the context of the ninth aspect of the invention, the term "reducing" embraces any degree of reduction, including reduction to zero. The reduction may for instance be 10% or more of the original concentration of the relevant additive, or 25 or 50 or 75 or 90% or more. The reduction may be as compared to the concentration of the additive which would otherwise have been incorporated into the composition or formulation in order to achieve the properties and performance required and/or desired of it in the context of its intended use. This may for instance be the concentration of the additive which was present in the composition or formulation prior to the realisation that a modified cyclodextrin (I) could be used in the way provided by the present disclosure, and/or which was present in an otherwise analogous additive composition or fuel or lubricant formulation which was intended (eg marketed) for use in an analogous context, prior to adding a modified cyclodextrin (I) to it in accordance with the invention.

The reduction in concentration of the additive may be as compared to the concentration of the additive which would be predicted to be necessary to achieve a desired property or performance for the composition or formulation in the absence of the modified cyclodextrin (I).

In the context of the sixth to the ninth aspects of the invention, the active substance may in particular be an antioxidant. The fuel or lubricant formulation may in particular be a gasoline or diesel fuel formulation, more particularly a gasoline fuel formulation.

According to a tenth aspect of the invention, there is provided the use of an additive composition according to the first aspect, in which the active substance is suitably an antioxidant, for the purpose of increasing the oxidative stability of a fuel or lubricant formulation or component thereof. The composition may be used to achieve any degree of improvement in the oxidative stability of the formulation or component, and/or to achieve or exceed a desired target level of oxidative stability.

Oxidative stability may be determined using any suitable method, for instance the standard test method IP 40 as in the examples below. In general, oxidative stability may be assessed with reference to the generation of an oxidation product such as a carboxylic acid or peroxide.

The invention may additionally or alternatively be used to adjust any property of a fuel or lubricant formulation or component thereof which is equivalent to or associated with oxidative stability. For example, in the case of a fuel formulation, improved oxidative stability may be associated with reduced deposit formation, improved combustion and energy efficiency for a system running on the fuel formulation, and with overall better retention of fuel properties. In the case of a lubricant formulation, improved oxidative stability may be associated with improved durability, longer oil drain intervals, reduced sludge and deposit formation and improved energy efficiency for a system in which the lubricant formulation is used, and with overall better retention of lubricant properties.

In the context of the present disclosure, "use" of a modified cyclodextrin (I) in a fuel or lubricant formulation or component thereof means incorporating the cyclodextrin into the formulation or component, typically as a blend (ie a physical mixture) with one or more other fuel or lubricant components, for example gasoline or diesel base fuels, and optionally one or more fuel or lubricant additives, and together with the relevant active substance. The cyclodextrin will conveniently—although not necessarily—be incorporated before the formulation or component is introduced into a fuel- or lubricant-consuming system. Instead or in addition, the use of a modified cyclodextrin (I) may involve running a fuel- or lubricant-consuming system, typically an internal combustion engine, on a fuel or lubricant formulation containing the cyclodextrin, typically by introducing the formulation into a combustion chamber of an engine. It may involve running a vehicle or other apparatus which is driven by a fuel- or lubricant-consuming system, on a fuel or lubricant formulation containing the cyclodextrin.

"Use" of a modified cyclodextrin (I) in the ways described above may also embrace supplying the cyclodextrin together with instructions for its use in a fuel or lubricant formulation or component thereof for one or more of the purposes described above in connection with the sixth to the tenth aspects of the invention. The cyclodextrin may itself be supplied as part of a composition which is suitable and/or adapted and/or intended for use as a fuel or lubricant additive, in particular an additive composition according to the first aspect of the invention or a premix according to the second aspect. In this case, the modified cyclodextrin may be included in such a composition or premix for any one or more of the purposes described above in connection with the sixth to the tenth aspects of the invention.

Thus a modified cyclodextrin (I) may be used, in a fuel or lubricant formulation or component thereof, in the form of an additive composition according to the first aspect of the invention or a premix according to the second aspect. "Use" of a modified cyclodextrin (I) may therefore comprise "use" of the invented additive composition or premix.

"Use" of a modified cyclodextrin (I) in an additive composition means incorporating the cyclodextrin into the composition, typically as a blend (ie a physical mixture) with an active substance, one or more solvent carriers and optionally one or more fuel or lubricant additives. The cyclodextrin will conveniently—although not necessarily—be incorporated before the composition is introduced into a fuel or lubricant formulation or component thereof, or into a fuel- or lubricant-consuming system. It may be incorporated in the form of a premix according to the second aspect of the invention. Instead or in addition, the use of a modified cyclodextrin (I) may involve running a fuel- or lubricant-consuming system, typically an internal combustion engine, on a fuel or lubricant formulation containing the cyclodextrin in the additive composition, typically by introducing the formulation into a combustion region of the system. It may involve running a vehicle or other apparatus which is driven by a fuel- or lubricant-consuming system, on a fuel or lubricant formulation containing the cyclodextrin in the additive composition.

"Use" of a modified cyclodextrin (I) in the ways described above may also embrace supplying the cyclodextrin together with instructions for its use in an additive composition for one or more of the purposes described above in connection with the sixth to the tenth aspects of the invention.

In general, references to "adding" a component to, or "incorporating" a component in, an additive composition or a fuel or lubricant formulation or component thereof may be taken to embrace addition or incorporation at any point during the production of the composition or formulation or component or at any time prior to its use.

Embodiments provided herein may be used to produce at least 1,000 liters of a modified cyclodextrin-containing additive composition or fuel or lubricant formulation, or at least 5,000 or 10,000 or 20,000 or 50,000 liters.

A fuel or lubricant formulation according to the invention, or which is prepared or used according to the invention, may be marketed with an indication that it benefits from an improvement due to the inclusion of the modified cyclodextrin (I), in particular improved efficacy, stability, solubility or activity for an active substance which is present in the formulation; improved delivery of such an active substance; and/or a lower concentration of an active substance or additive in the formulation. The marketing of such a formulation may comprise an activity selected from (a) providing the formulation in a container that comprises the relevant indication; (b) supplying the formulation with product literature that comprises the indication; (c) providing the indication in a publication or sign (for example at the point of sale) that describes the formulation; and (d) providing the indication in a commercial which is aired for instance on the radio, television or internet. The improvement may be attributed, in such an indication, at least partly to the presence of the modified cyclodextrin (I). The invention may involve assessing the relevant property of the formulation during or after its preparation. It may involve assessing the relevant property both before and after incorporation of the modified cyclodextrin, for example so as to confirm that the modified cyclodextrin contributes to the relevant improvement in the formulation.

An additive composition according to the invention, or which is prepared or used according to the invention, may be marketed with an indication that it benefits from an improvement due to the inclusion of the modified cyclodextrin (I), in particular improved efficacy, stability, solubility or activity for an active substance which is present in the composition; improved delivery of such an active substance; and/or a lower concentration of an active substance or additive in the composition. The marketing of such a composition may comprise an activity selected from (a) providing the composition in a container that comprises the relevant indication; (b) supplying the composition with product literature that comprises the indication; (c) providing the indication in a publication or sign (for example at the point of sale) that describes the composition; and (d) providing the indication in a commercial which is aired for instance on the radio, television or internet. The improvement may be attributed, in such an indication, at least partly to the presence of the modified cyclodextrin (I). The invention may involve assessing the relevant property of the composition during or after its preparation. It may involve assessing the relevant property both before and after incorporation of the modified cyclodextrin, for example so as to confirm that the modified cyclodextrin contributes to the relevant improvement in the composition.

In certain cases, a modified cyclodextrin (I) may itself contribute a technical effect on the properties and/or performance of a fuel or lubricant formulation, for example an antioxidant effect.

In particular it has been found—as shown in Examples 1 to 4 and 10 below—that a modified cyclodextrin of formula (I) can exhibit antioxidant activity in a fuel formulation. Thus, an eleventh aspect of the invention can provide a fuel or lubricant formulation comprising a modified cyclodextrin of formula (I) above. A twelfth aspect can provide the use of a modified cyclodextrin of formula (I), as an antioxidant in a fuel or lubricant formulation or in an additive composition for use in a fuel or lubricant formulation. The cyclodextrin (I) may in particular be an alkylated cyclodextrin such as is described above in connection with the first aspect of the invention, more particularly an alkylated β-cyclodextrin. It may for example be used in a fuel or lubricant formulation at a concentration of from 50 to 4,000 ppmw or from 100 to 2,000 ppmw.

Use as an antioxidant means use for the purpose of improving the oxidative stability of the relevant formulation or composition. Oxidative stability may be measured as described above in connection with the tenth aspect of the invention. The modified cyclodextrin (I) may instead or in addition be used to adjust another property which is equivalent to or associated with oxidative stability, again as described in connection with the tenth aspect.

Because the modified cyclodextrin (I) can act as an antioxidant, it can make possible the use of lower concentrations of other antioxidant additives in a fuel or lubricant formulation or an additive composition, without or without undue detriment to the oxidative stability of the formulation or of a fuel or lubricant formulation in which the additive composition is used. This can in turn reduce the cost and complexity of preparing the formulation or composition, and/or can provide greater versatility in fuel, lubricant or additive formulation practices.

These effects may be enhanced when the modified cyclodextrin (I) is also used to improve the activity, availability, solubility and/or stability of another antioxidant additive in the formulation, and/or to target its delivery.

In cases, a modified cyclodextrin (I) may be used to replace—at least partly, and in some cases completely—one or more other antioxidants in a fuel or lubricant formulation or additive composition. In cases it may be used as the only antioxidant in such a formulation or composition.

Accordingly, a thirteenth aspect of the invention provides the use of a modified cyclodextrin of formula (I) above, in an additive composition or in a fuel or lubricant formulation, for the purpose of reducing the concentration of an antioxidant present in the composition or formulation.

In the context of the thirteenth aspect of the invention, the term "reducing" embraces any degree of reduction, including reduction to zero. The reduction may for instance be 10% or more of the original concentration of the antioxidant, or 25 or 50 or 75 or 90% or more. The reduction may be as compared to the concentration of the antioxidant which would otherwise have been incorporated into the composition or formulation in order to achieve the properties and performance required and/or desired of it in the context of its intended use. This may for instance be the concentration of the antioxidant which was present in the composition or formulation prior to the realisation that a modified cyclodextrin (I) could be used in the way provided by the present disclosure, and/or which was present in an otherwise analogous additive composition or fuel or lubricant formulation which was intended (eg marketed) for use in an analogous context, prior to adding a modified cyclodextrin (I) to it in accordance with the invention.

The reduction in concentration of the antioxidant may be as compared to the concentration of the antioxidant which would be predicted to be necessary to achieve a desired property or performance for the composition or formulation, for example a desired level of oxidative stability, in the absence of the modified cyclodextrin (I).

In accordance with the eleventh to the thirteenth aspects of the invention, the modified cyclodextrin (I) may be used together with an active substance, which may be present at least partly as a guest molecule complexed with the modified cyclodextrin. Such an active substance may for example be selected from detergents, combustion improvers, antioxidants, and mixtures thereof; or from detergents, combustion improvers, and mixtures thereof.

In accordance with the eleventh to the thirteenth aspects of the invention, the fuel or lubricant formulation may in particular be a fuel formulation, more particularly a gasoline or diesel fuel formulation, yet more particularly a gasoline fuel formulation. In an embodiment, it may be a fuel formulation, in particular a diesel fuel formulation, which contains no, or only a low concentration of (for example 5% v/v or less, or 2% v/v or less, or 1 or 0.5% v/v or less of), oxygenate components, or at least of FAMEs such as POME.

In embodiments of the eleventh to the thirteenth aspects of the invention, the modified cyclodextrin (I) may be used in a fuel or lubricant formulation, in particular a fuel formulation such as a diesel fuel formulation, at a concentration of 500 ppmw or greater, or of 750 or 1,000 ppmw or greater. In such embodiments, the fuel formulation may in particular be a diesel fuel formulation containing an oxygenate component such as a FAME, for example 5% v/v or greater of such a component, or 7% v/v or greater. In other embodiments, however, it may be preferred for the fuel formulation to be a diesel fuel formulation which contains no, or only a low concentration of (for example 5% v/v or less, or 2% v/v or less, or 1 or 0.5% v/v or less of), oxygenate components, or at least of FAMEs such as POME.

In accordance with the eleventh to the thirteenth aspects of the invention, the modified cyclodextrin (I) may be used for two purposes simultaneously: as an antioxidant in its own right, and also as a vehicle ("host") for another active substance. In this respect, it can represent an improvement over other types of (typically inert) encapsulating vehicle, in that it can contribute a functionality of its own to affect the properties and/or performance of the overall formulation.

Throughout the description and claims of this specification, the words "comprise" and "contain" and variations of the words, for example "comprising" and "comprises", mean "including but not limited to", and do not exclude other moieties, additives, components, integers or steps. Moreover the singular encompasses the plural unless the context otherwise requires: in particular, where the indefinite article is used, the specification is to be understood as contemplating plurality as well as singularity, unless the context requires otherwise.

Preferred features of each aspect of the invention may be as described in connection with any of the other aspects. Other features of the invention will become apparent from the following examples. Generally speaking the invention extends to any novel one, or any novel combination, of the features disclosed in this specification (including any accompanying claims and drawings). Thus features, integers, characteristics, compounds, chemical moieties or groups described in conjunction with a particular aspect, embodiment or example of the invention are to be understood to be applicable to any other aspect, embodiment or example described herein unless incompatible therewith. For example, for the avoidance of doubt, the optional and preferred features (including concentrations) of the modified cyclodextrin (I), the active substance and the fuel or lubricant formulation can apply to all aspects of the invention in which the modified cyclodextrin, the active substance or the fuel or lubricant formulation are mentioned.

Moreover unless stated otherwise, any feature disclosed herein may be replaced by an alternative feature serving the same or a similar purpose.

Where upper and lower limits are quoted for a property, for example for the concentration of an additive or fuel component, then a range of values defined by a combination of any of the upper limits with any of the lower limits may also be implied.

In this specification, references to physical properties such as cyclodextrin, active substance, fuel, fuel component and lubricant component properties are—unless stated otherwise—to properties measured under ambient conditions, ie at atmospheric pressure and at a temperature from 16 to 22 or 25° C., or from 18 to 22 or 25° C., for example about 20° C.

Figure 2:
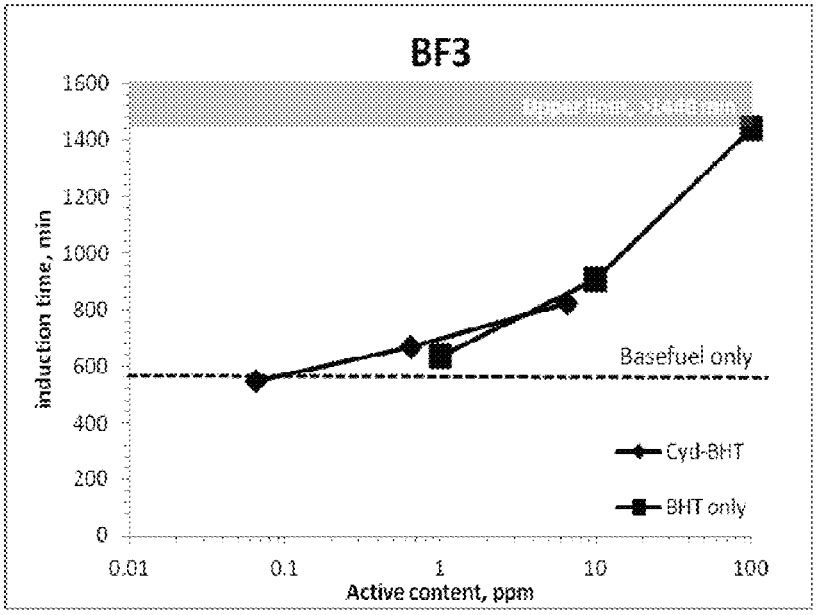
Figure 3:
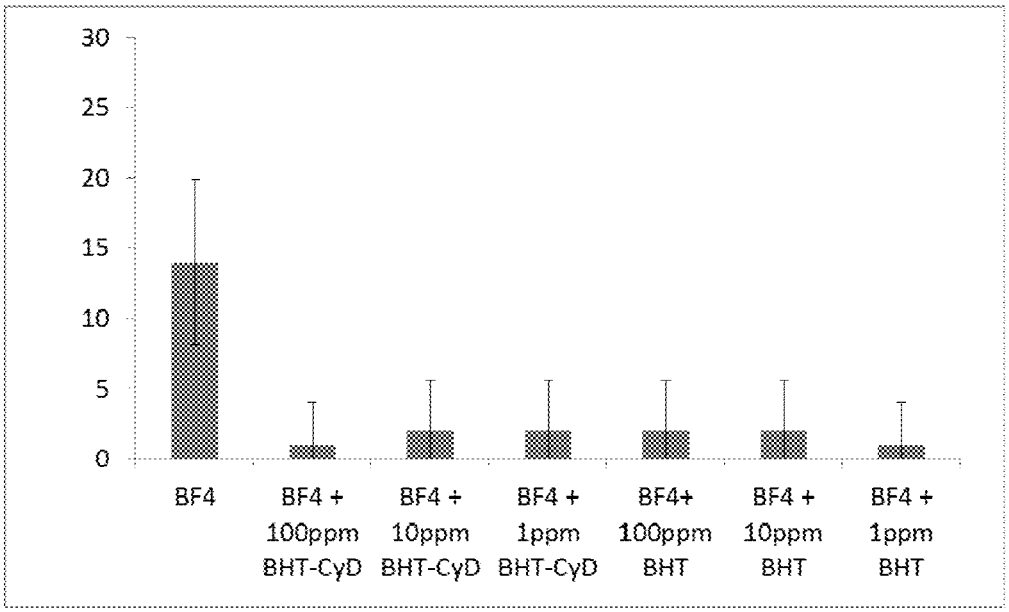
FIG. 3 is a bar chart showing results from the oxidative stability tests conducted in Example 4 below.
Figure 4A:
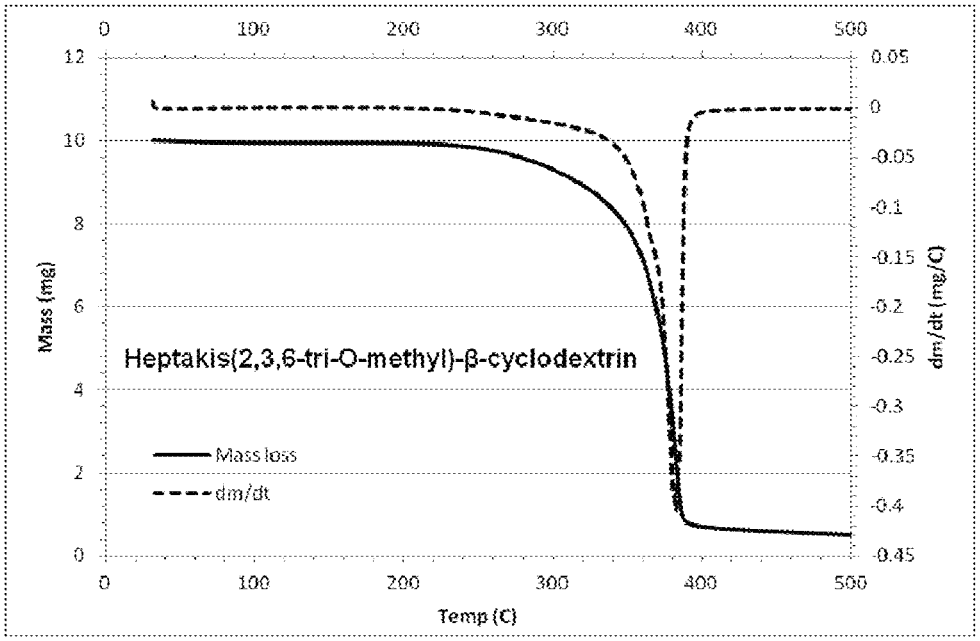
FIGS. 4A to 4C are graphs showing the results of the volatilisation experiments conducted in Example 5 below.
Figure 4B:
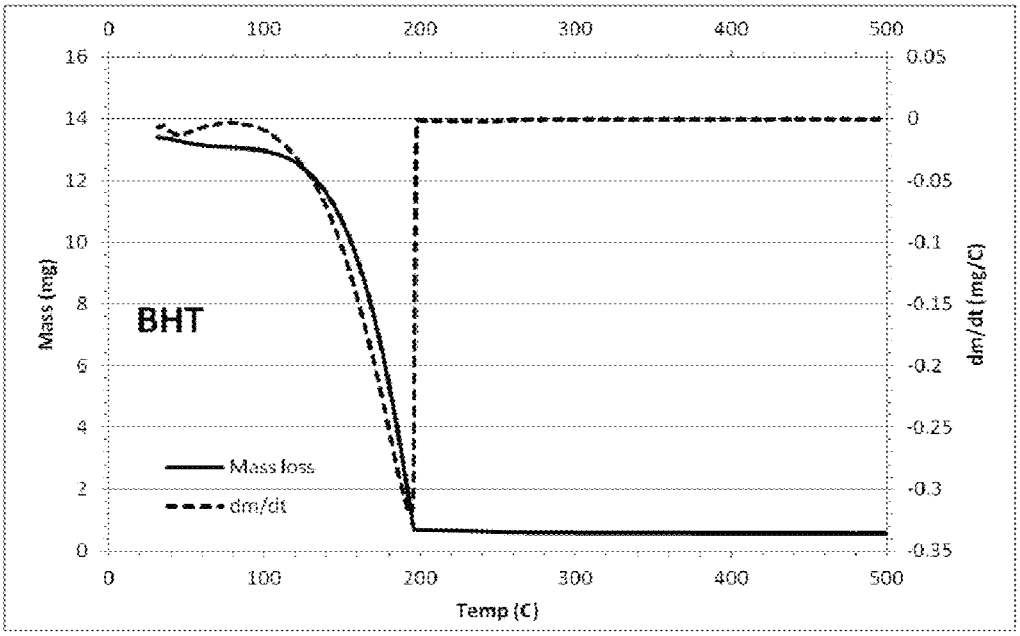
Figure 4C:
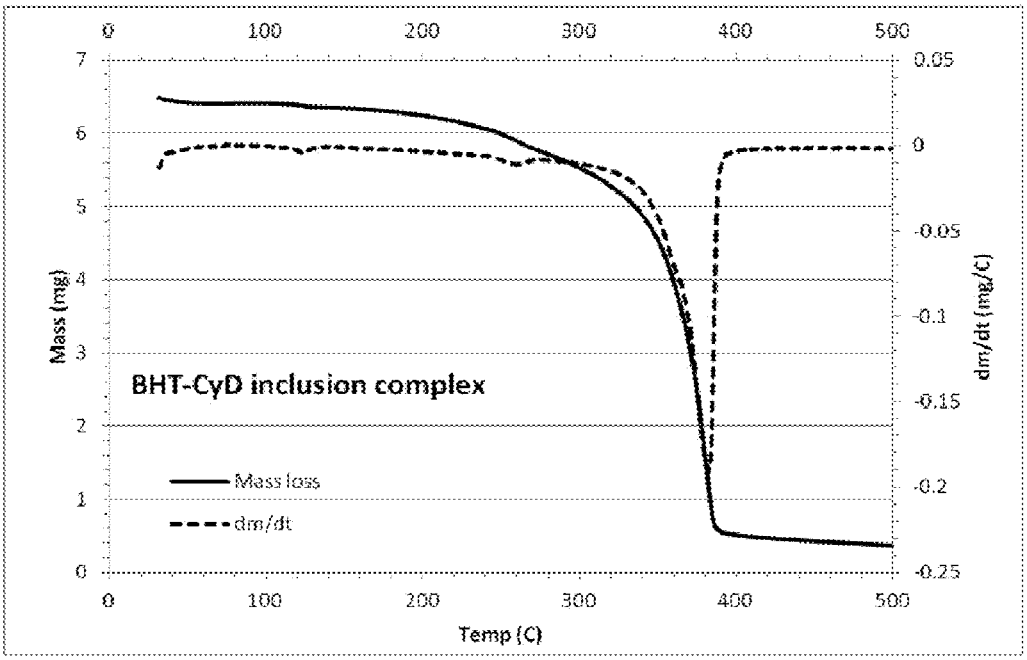
Figure 5A:
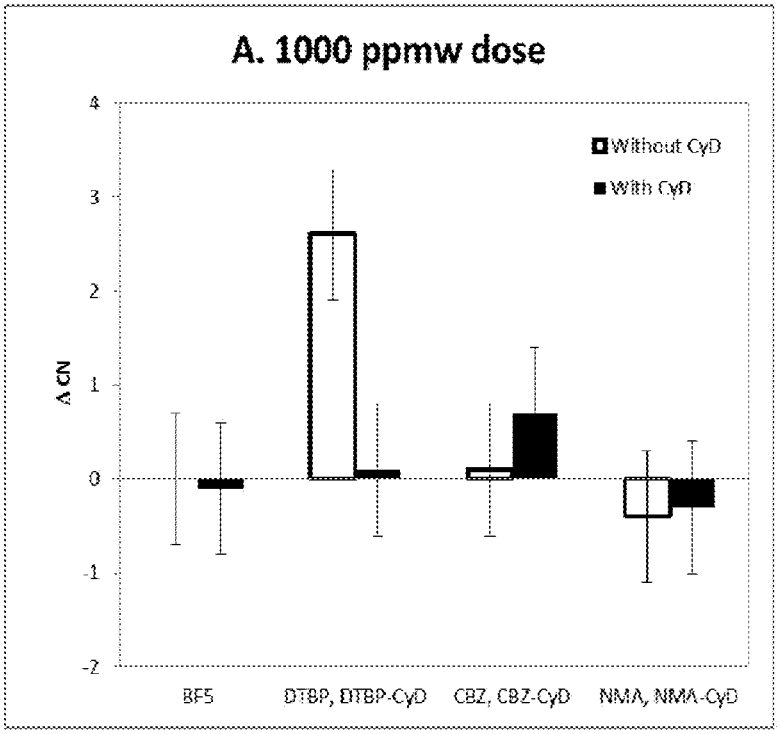
FIGS. 5A to 5D are bar charts showing the results of the cetane number measurements conducted in Examples 6 to 8 below.
Figure 5B:
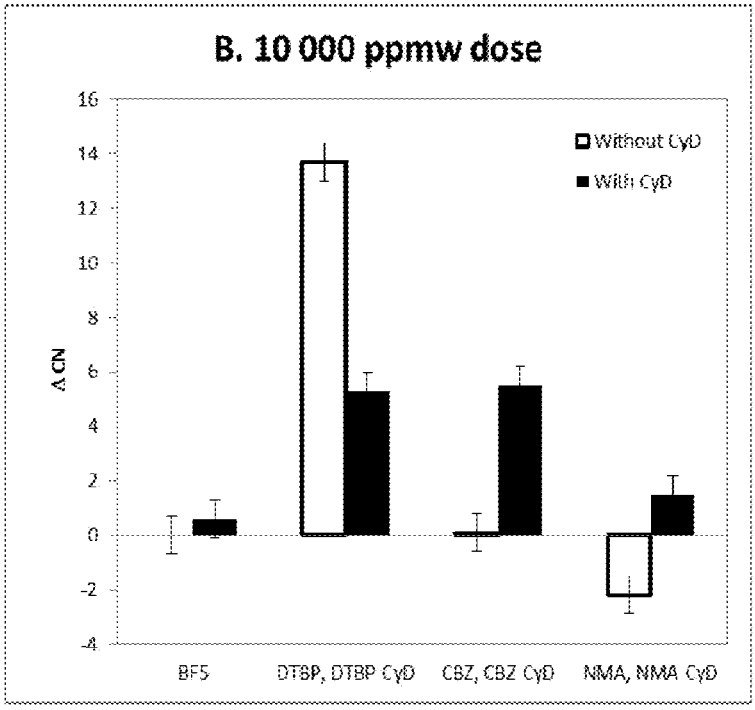
Figure 5C:
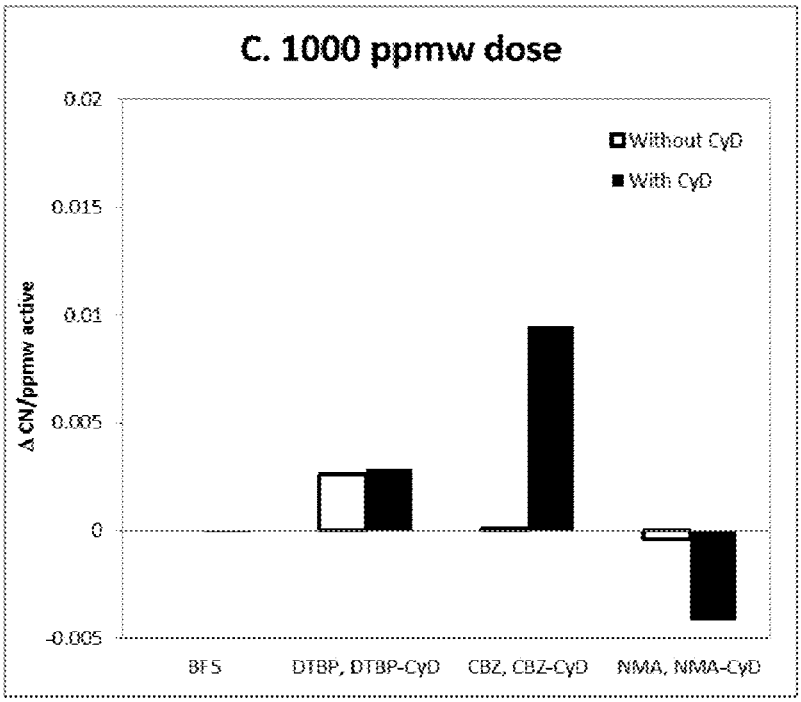
Figure 5D:
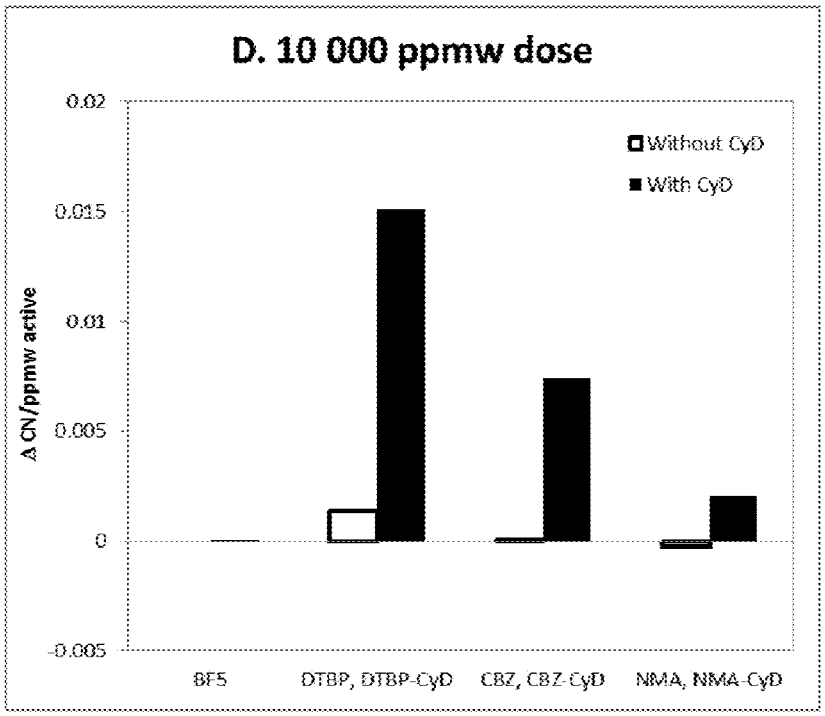
Figure 6A:
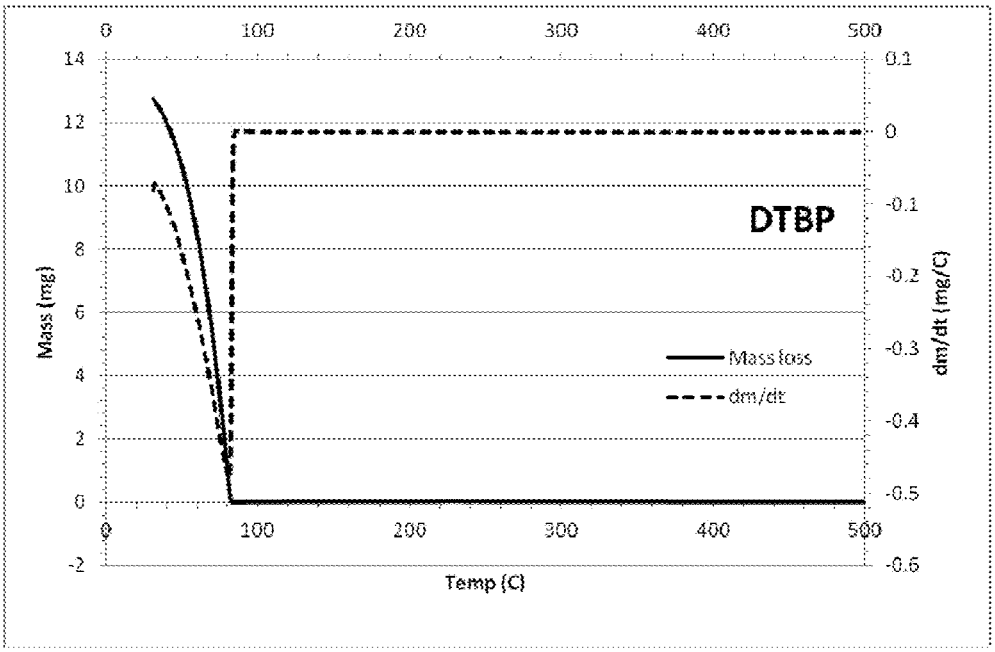
FIGS. 6A, 6B, 7A and 7B are graphs showing the results of the volatilisation experiments conducted in Example 9 below.
Figure 6B:
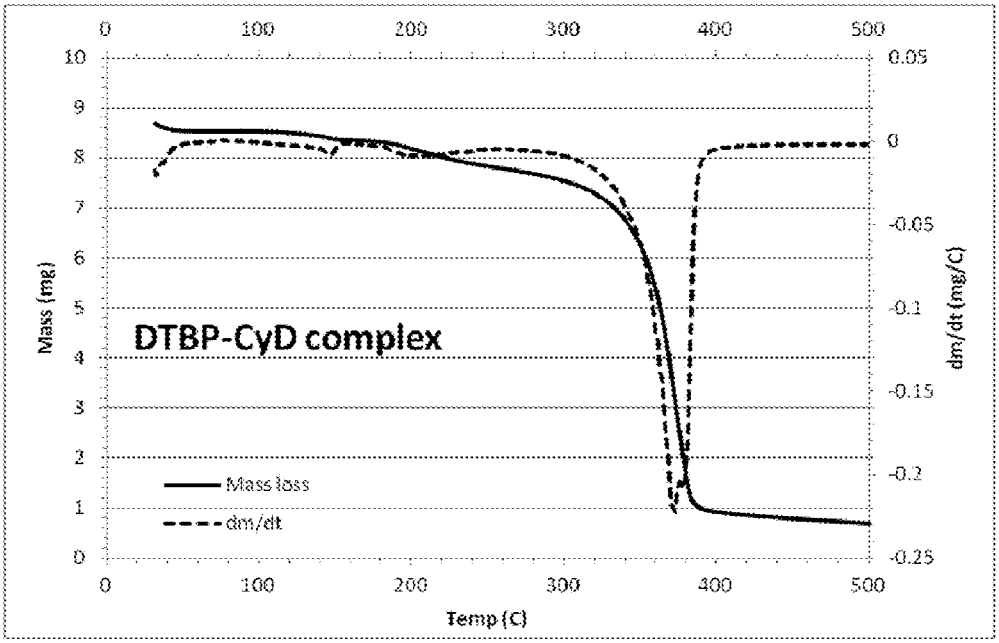
Figures 7A, 7B, 7C:
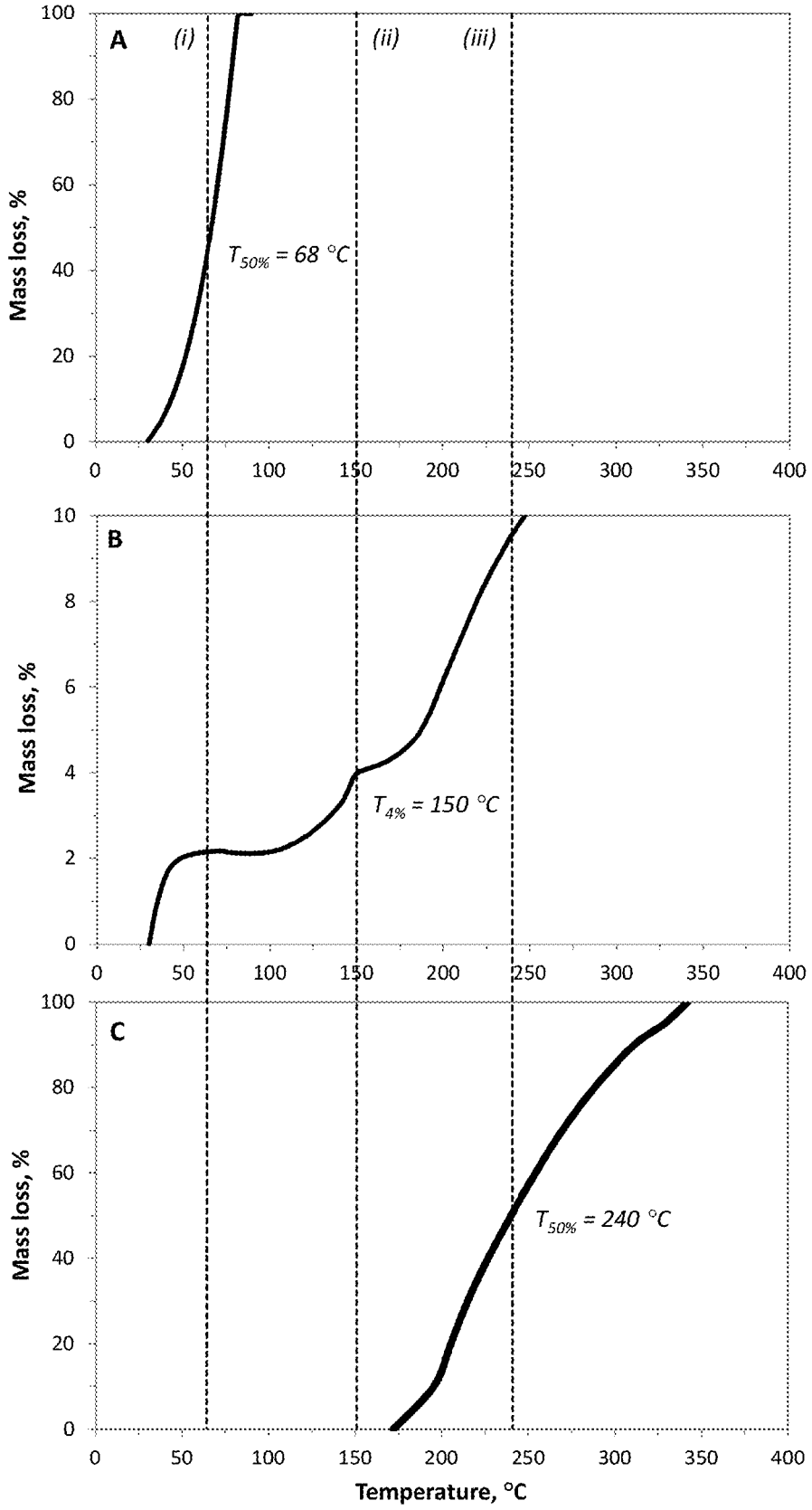
FIG. 7C is a distillation curve for a typical FAME-free diesel fuel, for comparison with FIGS. 7A and 7B as discussed in Example 9.

Embodiments provided herein will now be further described with reference to the following non-limiting examples and the accompanying illustrative drawings, of which:

FIGS. 1 and 2 are graphs showing the results of the induction time experiments conducted in Examples 2 and 3 below;

FIG. 3 is a bar chart showing results from the oxidative stability tests conducted in Example 4 below;

FIGS. 4A to 4C are graphs showing the results of the volatilisation experiments conducted in Example 5 below;

FIGS. 5A to 5D are bar charts showing the results of the cetane number measurements conducted in Examples 6 to 8 below;

FIGS. 6A, 6B, 7A and 7B are graphs showing the results of the volatilisation experiments conducted in Example 9 below; and FIG. 7C is a distillation curve for a typical FAME-free diesel fuel, for comparison with FIGS. 7A and 7B as discussed in Example 9.

EXAMPLES

Example 1

Gasoline Fuel Formulation

A solid additive composition was prepared, in accordance with the invention, by blending a modified cyclodextrin of formula (I) with the antioxidant BHT (butylated hydroxytoluene) using the kneading method. The composition had a BHT concentration of 6.5% w/w, as determined by UV spectrophotometry. It was sourced from Cyclolab R&D Laboratory (Hungary).

Fuel formulations in accordance with the invention were then prepared by blending the resultant additive composition with a gasoline base fuel BF1 at a range of blending ratios. The blending was effected by mixing the additive composition into the base fuel, and agitating the mixture until the solid was completely dissolved.

In order to assess the efficacy of the antioxidant in the fuel formulations, the standard test method IP 40 was used to measure their induction times. This test method involves subjecting a test fuel to accelerated oxidation conditions, and measuring the induction period to breakpoint in a pressure bomb apparatus, to provide a measure of the oxidation stability of the fuel. A longer induction time indicates that the test fuel is more resistant to oxidation. For comparison purposes, IP 40 induction times were also measured for the base fuel alone, and for blends of the base fuel with (a) unencapsulated BHT, ie BHT in the absence of the modified cyclodextrin, and (b) the cyclodextrin alone.

The base fuel BF1 was a commercially available lead-free gasoline base fuel sourced from the Shell Group of companies, which conformed to the European gasoline fuel specification EN 228. It did not contain any detergent or antioxidant or octane boosting additives, or any oxygenates such as ethanol. Its properties are summarised in Table 1 below.

TABLE 1

| Property | Units | Test method | BF1 |
|---|---|---|---|
| Density @ 15° C. | kg/m$^3$ | ASTM D4052 | 742.6 |
| VK40 | mm$^2$/s | IP 71 | 0.538 |
| Distillation: | | ASTM D86 | |
| 0% | ° C. | | 28.6 |
| 10% | | | 47.3 |
| 20% | | | 59.3 |
| 30% | | | 71.6 |
| 40% | | | 84.9 |
| 50% | | | 98.1 |
| 60% | | | 109.5 |
| 70% | | | 120.6 |
| 80% | | | 134.1 |
| 90% | | | 152.4 |
| 95% | | | 168.2 |
| 100% | | | 198.5 |
| Measured octane number MON | | ASTM D2700 | 85.1 |
| Research octane number RON | | ASTM D2699 | 96.4 |

The BHT was sourced from VWR. The cyclodextrin was heptakis(2,3,6-tri-O-methyl)-β-cyclodextrin, ie it had the formula (I) as defined above, in which n=7 (ie a β-cyclodextrin), and $R^1$, $R^2$ and $R^3$ were all methyl; it was sourced from Sigma-Aldrich.

The results of the induction time experiments are shown in Table 2 below. The BHT concentrations quoted refer to the BHT alone (where no cyclodextrin was present) or (in all other cases) to the BHT-cyclodextrin complex. "CyD" refers to the modified cyclodextrin. The Δ values represent the change in induction time compared to that of the base fuel BF1 alone.

TABLE 2

| Test fuel | BHT conc$^n$ (ppmw) | CyD conc$^n$ (ppmw) | Induction time (min) (IP 40) | Δ (min) |
|---|---|---|---|---|
| BF1 | 0 | 0 | 1156 | — |
| BF1 + BHT | 1 | 0 | 934 | −222 |
| BF1 + BHT | 10 | 0 | 1353 | 197 |
| BF1 + BHT | 100 | 0 | 1440* | 284 |

TABLE 2-continued

| Test fuel | BHT conc$^n$ (ppmw) | CyD conc$^n$ (ppmw) | Induction time (min) (IP 40) | Δ (min) |
|---|---|---|---|---|
| BF1 + CyD | 0 | 1 | 1331 | 175 |
| BF1 + CyD | 0 | 10 | 1440* | 284 |
| BF1 + CyD | 0 | 100 | 1178 | 22 |
| BF1 + CyD | 0 | 1000 | 1223 | 67 |
| BF1 + BHT-CyD | 1 | | 1091 | −65 |
| BF1 + BHT-CyD | 10 | | 1440* | 284 |
| BF1 + BHT-CyD | 100 | | 1440* | 284 |

*Upper detection limit = 1440 min

These data show that the antioxidant effect of the cyclodextrin-encapsulated BHT is comparable to that of the unencapsulated BHT. This confirms that the modified cyclodextrin (I) is suitable as a vehicle for the additive in the gasoline base fuel.

The data also show that the cyclodextrin alone has at least some antioxidant activity in a gasoline base fuel. It can thus be used to enhance the activity of an additive composition containing an antioxidant additive such as BHT.

Example 2

Additivated Gasoline Fuel Formulation

Example 1 was repeated, but using an alternative gasoline base fuel BF2. BF2 was the same as BF1, but contained a detergent additive package (ex BASF) at a treat rate of 420 ppmw. The additive package contained a PIB (polyisobutenyl)amine detergent.

The results of the induction time experiments are shown in Table 3 below, and illustrated graphically in FIG. 1. Again it can be seen that the antioxidant effect of the BHT is retained when encapsulated in the modified cyclodextrin, and also that the cyclodextrin itself exhibits antioxidant activity.

TABLE 3

| Test fuel | BHT conc$^n$ (ppmw) | CyD conc$^n$ (ppmw) | Induction time (min) (IP 40) | Δ (min) |
|---|---|---|---|---|
| BF2 | 0 | 0 | 637 | — |
| BF2 + BHT | 1 | 0 | 753 | 116 |
| BF2 + BHT | 10 | 0 | 1440* | 803 |
| BF2 + BHT | 100 | 0 | 1440* | 803 |
| BF2 + CyD | 0 | 1 | 819 | 182 |
| BF2 + CyD | 0 | 10 | 743 | 106 |
| BF2 + CyD | 0 | 100 | 1046 | 409 |
| BF2 + CyD | 0 | 1000 | 988 | 351 |
| BF2 + BHT-CyD | 1 | | 852 | 215 |
| BF2 + BHT-CyD | 10 | | 768 | 131 |
| BF2 + BHT-CyD | 100 | | 1326 | 689 |

*Upper detection limit = 1440 min

Example 3

Ethanol/Gasoline Fuel Formulation

Example 1 was repeated, but using an alternative gasoline base fuel BF3. BF3 was a blend containing 90% v/v of BF1 and 10% v/v ethanol, known as an "E10" fuel.

The results of the induction time experiments are shown in Table 4 below, and illustrated graphically in FIG. 2. Again the antioxidant effect of the BHT is retained when encapsulated in the modified cyclodextrin. The cyclodextrin alone also provides an antioxidant effect in the E10 fuel.

TABLE 4

| Test fuel | BHT conc$^n$ (ppmw) | CyD conc$^n$ (ppmw) | Induction time (min) (IP 40) | Δ (min) |
|---|---|---|---|---|
| BF3 | 0 | 0 | 566 | — |
| BF3 + BHT | 1 | 0 | 633 | 67 |
| BF3 + BHT | 10 | 0 | 904 | 338 |
| BF3 + BHT | 100 | 0 | 1440* | 874 |
| BF3 + CyD | 0 | 1 | 672 | 106 |
| BF3 + CyD | 0 | 10 | 743 | 177 |
| BF3 + CyD | 0 | 100 | 752 | 186 |
| BF3 + CyD | 0 | 1000 | 819 | 253 |
| BF3 + BHT-CyD | 1 | | 547 | −19 |
| BF3 + BHT-CyD | 10 | | 670 | 104 |
| BF3 + BHT-CyD | 100 | | 823 | 257 |

*Upper detection limit = 1440 min

Example 4

Diesel Fuel Formulation

Example 1 was repeated, but using a commercially available ultra low sulphur diesel base fuel BF4. The base fuel was sourced from the Shell Group of companies and conformed to the European diesel fuel specification EN 590. It did not contain any detergent, antioxidant or ignition-improving additives, or any oxygenates such as fatty acid methyl esters, or any 2-ethylhexyl nitrate (2-EHN). Its properties are summarised in Table 5 below.

TABLE 5

| Property | Units | Test method | BF4 |
|---|---|---|---|
| Density @ 15° C. | kg/m$^3$ | ASTM D4052 | 832.6 |
| VK40 | mm$^2$/s | IP 71 | 2.67 |
| Distillation: | | ASTM D86 | |
| 0% | ° C. | | 170.7 |
| 10% | | | 193.7 |
| 20% | | | 209.7 |
| 30% | | | 227.8 |
| 40% | | | 247.7 |
| 50% | | | 268.9 |
| 60% | | | 288.5 |
| 70% | | | 305.8 |
| 80% | | | 321.9 |
| 90% | | | 339.1 |
| 95% | | | 352.6 |
| 100% | | | 361.5 |
| Rec at 250° C. | % v/v | | 41.4 |
| Rec at 350° C. | % v/v | | 94.2 |
| Cetane number | | | 54.4 |

In this case, oxidative stabilities were assessed using the standard test method IP 388. The results are shown in Table 6 below: those for the BHT and BHT-cyclodextrin complex are also illustrated graphically in FIG. 3. A lower residue indicates a higher oxidative stability. The BHT concentrations quoted refer to the BHT alone (where no cyclodextrin was present) or (in all other cases) to the BHT-cyclodextrin complex. In FIG. 3, the y axis shows residues in g/m$^3$.

TABLE 6

| Test fuel | BHT conc$^n$ (ppmw) | CyD conc$^n$ (ppmw) | Residue (g/m$^3$) (IP 388) |
|---|---|---|---|
| BF4 | 0 | 0 | 14.0 |
| BF4 + BHT | 1 | 0 | 1.0 |
| BF4 + BHT | 10 | 0 | 2.0 |

TABLE 6-continued

| Test fuel | BHT conc$^n$ (ppmw) | CyD conc$^n$ (ppmw) | Residue (g/m$^3$) (IP 388) |
|---|---|---|---|
| BF4 + BHT | 100 | 0 | 2.0 |
| BF4 + CyD | 0 | 1 | 1.0 |
| BF4 + CyD | 0 | 10 | 2.0 |
| BF4 + CyD | 0 | 100 | 1.0 |
| BF4 + CyD | 0 | 1000 | 3.0 |
| BF4 + BHT-CyD | 1 | | 1.0 |
| BF4 + BHT-CyD | 10 | | 2.0 |
| BF4 + BHT-CyD | 100 | | 2.0 |

The Table 6 data show that in the diesel base fuel as well as in the gasoline fuels, the antioxidant effect of the cyclodextrin-encapsulated BHT is comparable to that of the BHT alone. This is evidenced by the low residues formed in the presence of BHT—either as a pure component (BHT only) or in encapsulated (BHT-CyD) form—compared to those formed in the unadditivated base fuel. The antioxidant effect of the BHT may even be enhanced at higher additive concentrations.

Again, the modified cyclodextrin alone also appears to have an antioxidant effect on the base fuel.

Example 5

Additive Release

This example demonstrates the temperature-dependent release of an encapsulated active substance from a modified cyclodextrin host molecule, and thus the potential to use the cyclodextrin to target release of the active substance.

The solid form BHT-cyclodextrin inclusion complex used in Examples 1 to 4 was subjected to thermogravimetric analysis, to determine the temperature at which the BHT molecule was released from the inclusion complex. For comparison, the BHT alone and the cyclodextrin alone were subjected to the same analysis. The results for the three samples are shown in FIGS. 4A (cyclodextrin alone), 4B (BHT alone) and 4C (inclusion complex). The solid lines show the mass loss with temperature, and the dashed lines the rate of loss of mass with time (ie dm/dt). Mass loss is a useful metric for assessing the thermal evaporation and/or thermal degradation of organic molecules.

It can be seen from FIG. 4 that the modified cyclodextrin begins to undergo mass loss at around 250-380° C. Unencapsulated BHT undergoes mass loss between 100 and 200° C. When BHT is complexed with the modified cyclodextrin (FIG. 4C), however, the temperature range of mass loss is increased to between 200 and 300° C. This confirms that the protection of BHT from evaporation and/or thermal degradation is achievable through encapsulation within the cyclodextrin host molecules.

Thus, the cyclodextrin reduces the volatility of the BHT, effectively delaying its release until the BHT-cyclodextrin complex dissociates. This can be used to target delivery of the BHT to a specific temperature regime. For example, the operating temperature within the fuel injection equipment of a typical gasoline or diesel engine is likely to be in the range from 60 to 150° C. It is the fuel injection equipment where the effects of an antioxidant additive are particularly useful. However, an unencapsulated additive such as BHT could be lost through volatilisation or thermal degradation before reaching the fuel injection equipment. A modified cyclodextrin (I) can be used to delay release of the additive until the point, within the higher temperature fuel injection equipment, where it is most needed to help reduce build-up of oxidation products, thus effectively increasing its efficacy.

At the same time, Examples 1 to 4 demonstrate that encapsulation of the additive does not significantly impair its antioxidant effects on a fuel formulation, and indeed that the modified cyclodextrin contributes antioxidant activity of its own. The gasoline induction time tests and diesel oxidative stability tests were carried out at temperatures of around 150° C. and 95° C. respectively, ie at temperatures comparable to those within the fuel injection equipment of a gasoline or diesel engine.

Example 6

Diesel Fuel Formulation

A solid additive composition was prepared, in accordance with the invention, by blending a modified cyclodextrin of formula (I) with the known cetane improver additive di-t-butyl peroxide (DTBP) using the kneading method. The composition had a DTBP concentration of 3.5% w/w, as determined by gas chromatography.

Diesel fuel formulations in accordance with the invention were then prepared by blending the resultant additive composition with a diesel base fuel BF5 at dose rates of both 1,000 ppmw and 10,000 ppmw, corresponding respectively to 35 and 350 ppmw of the DTBP in the finished fuel formulations. The blending was effected by mixing the additive composition into the base fuel, and agitating the mixture until the solid was completely dissolved.

In order to assess the efficacy of the cetane improver in the fuel formulations, the standard test method IP 498/06 was used to measure their IQT cetane numbers. For comparison purposes, IP 498/06 cetane numbers were also measured for the base fuel alone, and for blends of the base fuel with (a) unencapsulated DTBP, ie DTBP in the absence of the modified cyclodextrin, and (b) the cyclodextrin alone.

The base fuel BF5 was a so-called "B7" diesel base fuel containing 7% v/v of the biofuel component POME (palm oil methyl ester). It was sourced from the Shell Group of companies and conformed to the European diesel fuel specification EN 590. It did not contain any detergent or cetane improving additives. Its properties are summarised in Table 7 below.

TABLE 7

| Property | Units | Test method | BF5 |
|---|---|---|---|
| Density @ 15° C. | kg/m$^3$ | ASTM D4052 | 836.1 |
| VK40 | mm$^2$/s | IP 71 | 2.738 |
| Distillation: | | IP 123 | |
| 0% | ° C. | | 169.8 |
| 10% | | | 195.6 |
| 20% | | | 212.7 |
| 30% | | | 232.6 |
| 40% | | | 254.5 |
| 50% | | | 277.7 |
| 60% | | | 297.1 |
| 70% | | | 312.6 |
| 80% | | | 325.7 |
| 90% | | | 339.2 |
| 95% | | | 350.8 |
| 100% | | | 358.6 |
| Rec at 250° C. | % v/v | | 37.8 |
| Rec at 350° C. | % v/v | | 94.8 |
| Cetane number | | ASTM D613 | 54.0 |

The DTBP was sourced from VWR. The cyclodextrin was (2,3,6-tri-O-methyl)-β-cyclodextrin, as used in the previous examples. The DTBP-cyclodextrin complex was sourced from Cyclolab R&D Laboratory (Hungary).

The results of the cetane number measurements are shown in Table 8 below. "CN" refers to cetane number according to IP 498/06; "CyD" refers to the modified cyclodextrin. The "active" concentrations quoted refer to the DTBP alone. The "dose" figures are the concentrations at which either the DTBP or the DTBP-cyclodextrin complex was present in the test fuel formulation. The Δ values represent the change in cetane number compared to that of the base fuel BF5 alone. For calculating the Δ values, the "active" concentrations for the formulations containing only BF5 and/or CyD were taken to be 1.

The results are discussed at the end of Example 8.

Example 7

Diesel Fuel Formulation

Example 6 was repeated, but using another known combustion improver, carbazole, in place of the DTBP. The carbazole was sourced from VWR. It was blended with the modified cyclodextrin to give a solid form additive composition having a carbazole concentration of 7.4% w/w, as determined by UV-vis spectroscopy. The carbazole-cyclodextrin complex was sourced from Cyclolab R&D Laboratory (Hungary).

The results of the cetane number measurements are also shown in Table 8. In this context, the "active" concentrations quoted refer to the carbazole (CBZ) alone. The "dose" figures are the concentrations at which either the carbazole or the carbazole-cyclodextrin complex was present in the test fuel formulation. These results are also discussed at the end of Example 8.

Example 8

Diesel Fuel Formulation

Example 6 was repeated, but using N-methyl aniline (NMA) in place of the DTBP. NMA has been used as an octane booster in gasoline fuel formulations, and is therefore known to act as a cetane number suppressant. The NMA was sourced from VWR. It was blended with the modified cyclodextrin to give a solid form additive composition having an NMA concentration of 7.2% w/w, as determined by UV-vis spectroscopy. The NMA-cyclodextrin complex was sourced from Cyclolab R&D Laboratory (Hungary).

The results of the cetane number measurements are also shown in Table 8. In this context, the "active" concentrations quoted refer to the NMA alone, and the "dose" figures are the concentrations at which either the NMA or the NMA-cyclodextrin complex was present in the test fuel formulation. The results are discussed at the end of this example.

TABLE 8

| Test fuel | Additive dose (ppmw) | Active conc$^n$ (ppmw) | CN (IQT) (IP 498/06) | Δ CN | Δ CN/ ppmw active |
|---|---|---|---|---|---|
| BF5 | 0 | 0 | 56.2 | 0 | 0 |
| BF5 + CyD | 1,000 | 0 | 56.1 | −0.1 | −0.1 |
| BF5 + CyD | 10,000 | 0 | 56.8 | 0.6 | 0.6 |
| BF5 + DTBP | 1,000 | 1,000 | 58.8 | 2.6 | 0.0026 |
| BF5 + DTBP | 10,000 | 10,000 | 69.9 | 13.7 | 0.00137 |

TABLE 8-continued

| Test fuel | Additive dose (ppmw) | Active conc$^n$ (ppmw) | CN (IQT) (IP 498/06) | Δ CN | Δ CN/ ppmw active |
|---|---|---|---|---|---|
| BF5 + DTBP-CyD | 1,000 | 35 | 56.3 | 0.1 | 0.002857143 |
| BF5 + DTBP-CyD | 10,000 | 350 | 61.5 | 5.3 | 0.015142857 |
| BF5 + CBZ | 1,000 | 1,000 | 56.3 | 0.1 | 1E−04 |
| BF5 + CBZ | 10,000 | 10,000 | 56.3 | 0.1 | 1E−05 |
| BF5 + CBZ-CyD | 1,000 | 74 | 56.9 | 0.7 | 0.009459459 |
| BF5 + CBZ-CyD | 10,000 | 740 | 61.7 | 5.5 | 0.007432432 |
| BF5 + NMA | 1,000 | 1,000 | 55.8 | −0.4 | −0.0004 |
| BF5 + NMA | 10,000 | 10,000 | 54 | −2.2 | −0.00022 |
| BF5 + NMA-CyD | 1,000 | 72 | 55.9 | −0.3 | −0.004166667 |
| BF5 + NMA-CyD | 10,000 | 720 | 57.7 | 1.5 | 0.002083333 |

The Table 8 data are illustrated as bar charts in FIG. 5. FIG. 5A shows the changes in cetane number caused by each of the actives, both with and without the modified cyclodextrin, for the formulations containing 1,000 ppmw of the additive composition. FIG. 5B shows the cetane number changes caused at the 10,000 ppmw additive dose rate. Error bars in FIGS. 5A and 5B represent the measurement error of 0.7 cetane number as described in IP498/06. FIGS. 5C and 5D show the changes in cetane number per ppmw of active, for the formulations containing, respectively, 1,000 and 10,000 ppmw of the additive composition.

Discussion of Examples 6-8

The results from Examples 6 to 8 show that the modified cyclodextrin alone has relatively little effect on the cetane number of the diesel base fuel.

Example 6 shows that the known cetane improver DTBP increases the cetane number of the base fuel, to an extent which depends on its concentration in the overall fuel formulation. When encapsulated in the modified cyclodextrin, the DTBP retains its cetane-enhancing activity (taking account of the actual DTBP concentration when added as part of a larger cyclodextrin complex). This confirms that the modified cyclodextrin (I) is suitable as a vehicle for the additive in the diesel base fuel. Surprisingly, however, the encapsulated DTBP has a greater effect on the base fuel cetane number than when unencapsulated. This increase in activity appears to be greater at the higher additive dose rate, where up to ten times less of the DTBP is necessary to achieve the same cetane number. Here, the potency of the encapsulated DTBP ($1.5\times10^{-2}$ ppmw$^{-1}$) is approximately an order of magnitude greater than that of the unencapsulated DTBP ($1.4\times10^{-3}$ ppmw$^{-1}$).

It is believed, although we do not wish to be bound by this theory, that this effect may be due to an effective reduction in volatility of the DTBP when encapsulated in the modified cyclodextrin (see Example 9). The encapsulated additive may be less likely to evaporate from the fuel formulation prior to the point of combustion, or to degrade within the formulation, resulting in a higher concentration of available additive at the critical time. The high temperatures to which the fuel formulation is exposed at the time of combustion are likely to cause degradation of the cyclodextrin host and volatilisation of the DTBP guest molecules, the DTBP then being available to impart its cetane-boosting effect on the fuel at the time when most needed. Thus, the modified cyclodextrin may be used not only to improve the stability and prolong the effective lifetime of the DTBP additive, but also to target its delivery.

Example 7 shows that carbazole alone has little or no effect on the cetane number of the base fuel. Surprisingly, however, when encapsulated in the modified cyclodextrin, it can significantly increase the base fuel cetane number, in particular at the higher additive dose rate. Thus, a compound which might not otherwise be expected to be of use as a cetane improver—and indeed is in theory better known as an octane booster—can apparently be used as such when combined with a modified cyclodextrin (I). It is believed, although we do not wish to be bound by this theory, that this effect may be due to an effective increase in solubility for the encapsulated additive. Carbazole alone is crystalline and relatively insoluble in diesel. When present as a guest molecule within a more soluble cyclodextrin, it can be better dispersed in a diesel fuel formulation, making it more readily available for imparting a cetane-enhancing effect. Cyclodextrin encapsulation both solubilises the carbazole molecule and inhibits its precipitation, leaving the molecule better able to participate in combustion and oxidation reactions.

Carbazole is also only marginally soluble in gasoline, which can limit its use at higher concentrations as an octane improver. The present invention may therefore make possible the use of higher concentrations of carbazole, and potentially other low solubility combustion improving additives, in both gasoline and diesel fuel formulations, in order to achieve greater combustion improvements. In this way, a modified cyclodextrin (I) may be used to increase the solubility, and thus the efficacy, of a combustion improving additive.

NMA alone (Example 8) can be seen to act as a cetane suppressant. However, the combination of the NMA with the modified cyclodextrin surprisingly causes less of a reduction in cetane number, and at the higher additive dose rate can actually yield an overall increase in cetane number. Thus, again, a compound which might not otherwise be expected to be of use as a cetane improver can apparently be used as such when combined with a modified cyclodextrin (I): this can greatly increase the options available to the fuel formulator wishing to produce a diesel fuel with good cetane quality. This effect is particularly surprising since the mechanisms by which a substance acts as either a cetane improver or an octane improver are often complex. Although we do not wish to be bound by this theory, it is believed that the effect may be at least partly due to intermolecular interactions between the NMA and the cyclodextrin, the encapsulation bringing the relevant functional groups into closer proximity. For example, the amine moiety on the NMA may hydrogen bond with the ether moieties of the cyclodextrin, thus altering the electronic structure of the guest molecule and potentially stretching and weakening the N—H bond. In this state, radical formation may occur more readily. Similar effects are likely to be occurring in the carbazole-cyclodextrin system.

It can thus be seen that in accordance with the invention, a modified cyclodextrin (I) can be used as a vehicle for a combustion improving additive in a fuel formulation. Encapsulation of the additive in the cyclodextrin does not appear to be detrimental to its activity. On the contrary: it can help to solubilise the additive in the fuel formulation, and/or to improve its stability, and in turn to increase its efficacy. In cases, encapsulation of an additive in a modified cyclodextrin (I) can modify the nature of its activity, for instance causing a cetane-improving effect which might not otherwise be available.

As a result, a potentially wider range of active substances may be available for use as combustion improvers in fuel formulations. Moreover, known combustion improvers such as DTBP may be usable at lower concentrations due to the activity-enhancing effect of a modified cyclodextrin vehicle, and/or due to the ability of the cyclodextrin to target release of the additives.

Example 9

Additive Release

This example demonstrates the temperature-dependent release of an encapsulated cetane improver from a modified cyclodextrin host molecule, and thus the potential to use the cyclodextrin to target release of the cetane improver.

The solid additive composition of Example 6 was subjected to thermogravimetric analysis (TGA), to determine the temperature at which the DTBP molecule was released from the inclusion complex. For comparison, the DTBP alone was subjected to the same analysis. The results for the two samples are shown in FIGS. 6A (DTBP alone) and 6B (inclusion complex). The solid lines show the mass loss with temperature, and the dashed lines the rate of loss of mass with time (ie dm/dt). For comparison, reference can be made to FIG. 4A, which shows the TGA results for the cyclodextrin alone.

It can be seen from FIG. 6A that the unencapsulated DTBP undergoes mass loss between 40 and 100° C. However, when the active is complexed with cyclodextrin host molecules (FIG. 6B), DTBP mass loss occurs between 150 and 250° C. These increases in mass loss onset temperatures confirm that the DTBP is encapsulated within the cyclodextrin host molecules. More energy is then required to overcome the association between the cyclodextrin and the DTBP, and volatilisation therefore requires a higher temperature.

The practical implications of these results can be seen from FIGS. 7A to 7C. FIGS. 7A and 7B show the mass loss for samples of unencapsulated and encapsulated DTBP respectively. FIG. 7C shows the distillation (recovery) curve for a typical FAME-free diesel fuel. The mass loss of unencapsulated DTBP (FIG. 7A) occurs via evaporation and/or thermal degradation, with the temperature of 50% mass loss ($T_{50\%}$) occurring at 68° C. The mass loss of encapsulated DTBP, in contrast, occurs at a higher temperature of 150° C. For the DTBP-CyD complex, a mass loss of 4% represents approximately 50% DTBP mass loss, taking account of the actual DTBP concentration of 3.5% less the start-of-experiment mass drift of 2%.

It can be seen from FIG. 7 that encapsulation suppresses volatility to a temperature range which better overlaps with the diesel light ends. In use in an internal combustion engine, post-ignition, the light ends and the encapsulated (lower volatility) DTBP will be present in the same air-fuel regions and will thus deliver cetane-boosting properties more effectively. The cyclodextrin will also protect the DTBP from premature thermal decomposition, and thus reduce loss. These two mechanisms are believed to contribute to the increased potency observed when the DTBP is complexed with the modified cyclodextrin (I). Example 11 below confirms that such activity-enhancing effects are indeed maintained during use in a diesel engine.

Thus, the cyclodextrin reduces the volatility of the DTBP, effectively delaying its release until the DTBP-cyclodextrin complex dissociates. This can be used to target delivery of the DTBP to a specific temperature regime. For example, the operating temperature within the fuel common rail or injector of a typical diesel engine is likely to be in the range from, respectively, 60 to 150° C. or 60 to 220° C. It is the combustion chamber of the diesel engine where the effects of a cetane improver are particularly useful. However, an unencapsulated additive such as DTBP could be lost through volatilisation or thermal degradation before reaching the fuel injection equipment. A modified cyclodextrin (I) can be used to delay release of the additive until the point, within the higher temperature fuel injection equipment or combustion chamber, where it is most needed to help improve combustion, thus effectively increasing its efficacy.

At the same time, Examples 6 to 8 and 11 demonstrate that encapsulation of the additive does not significantly impair—indeed, often increases—its cetane improving effects on a fuel formulation.

It has been found that other active substances, including NMA, can benefit from similar enhancements in thermal stability through encapsulation in a modified cyclodextrin of formula (I): see also Example 5 above.

Example 10

Diesel Fuel Formulation

The additive composition of Example 1, containing BHT with heptakis(2,3,6-tri-O-methyl)-β-cyclodextrin, was tested in the diesel base fuel BF5 (as used in Example 6). Fuel formulations were prepared by mixing the additive composition into the base fuel at a range of blending ratios, and agitating the mixture until the solid was completely dissolved.

The RANCIMAT test (standard test method EN 15751) was used to assess the efficacy of the antioxidant in these biodiesel-containing fuel formulations. This test determines the induction time of a test fuel prior to the onset of oxidation reactions: again, a longer induction time indicates a greater resistance to oxidation, ie a higher oxidative stability. For comparison purposes, RANCIMAT induction times were also measured for the base fuel alone, and for blends of the base fuel with (a) unencapsulated BHT, ie BHT in the absence of the modified cyclodextrin, and (b) the cyclodextrin alone.

The results are shown in Table 9 below. The "BHT concentration" quoted in the second column is, in the case of the samples containing the BHT-cyclodextrin complex, the concentration of the complex rather than of the BHT active contained within it.

It can be seen that the antioxidant effect of the BHT is retained when encapsulated in the modified cyclodextrin. The cyclodextrin alone also exhibits a significant antioxidant effect when present at 1,000 ppmw.

TABLE 9

| Test fuel | BHT conc$^n$ (ppmw) | CyD conc$^n$ (ppmw) | Induction time (hrs) (RANCIMAT) |
|---|---|---|---|
| BF6 | 0 | 0 | 8.9 |
| BF6 + BHT | 1 | 0 | 11.1 |
| BF6 + BHT | 10 | 0 | 12.7 |
| BF6 + BHT | 100 | 0 | 15.3 |
| BF6 + CyD | 0 | 1 | 9.2 |
| BF6 + CyD | 0 | 10 | 8.5 |
| BF6 + CyD | 0 | 100 | 8.4 |
| BF6 + CyD | 0 | 1,000 | 10.3 |
| BF6 + BHT-CyD | 1 | | 9.9 |
| BF6 + BHT-CyD | 10 | | 11.5 |
| BF6 + BHT-CyD | 100 | | 11.5 |

(Repeatability (r) of test: r = 0.09x + 0.16)

Example 11

Diesel Fuel Formulation

A solid additive composition was prepared, in accordance with the invention, by blending heptakis(2,3,6-tri-O-methyl)-β-cyclodextrin (TRIMEB) with the known cetane improver EHN using the kneading method. The composition had an EHN concentration of 9-10% w/w, as determined by gas chromatography. It was sourced from Cyclolab R&D Laboratory (Hungary).

Diesel fuel formulations in accordance with the invention were then prepared by blending the resultant additive composition with a diesel base fuel BF6 at dose rates of both 2,000 and 4,000 ppmw, corresponding respectively to 200 and 400 ppmw of the EHN in the finished fuel formulations.

The base fuel BF6 was a B7 diesel base fuel containing 7% v/v of POME, sourced from the Shell Group of companies and conforming to the European diesel fuel specification EN 590. It did not contain any detergent or cetane improving additives. Its properties are summarised in Table 10 below.

TABLE 10

| Property | Units | Test method | BF2 |
|---|---|---|---|
| Density @ 15° C. | kg/m$^3$ | ASTM D4052 | 833.8 |
| Distillation: | | IP 123 | |
| 0% | ° C. | | 176.1 |
| 10% | | | 210.8 |
| 20% | | | 225.9 |
| 30% | | | 241.2 |
| 40% | | | 255.3 |
| 50% | | | 268.7 |
| 60% | | | 281.7 |
| 70% | | | 295.7 |
| 80% | | | 311.7 |
| 90% | | | 332.6 |
| 95% | | | 349.2 |
| 100% | | | 358.5 |
| Rec at 250° C. | % v/v | | 36.4 |
| Rec at 350° C. | % v/v | | 95.2 |
| Cetane number | | ASTM D613 | 52.4 |

A further formulation was prepared containing 600 ppmw of the EHN-TRIMEB additive composition and an additional 600 ppmw of EHN, corresponding to a total EHN content of 660 ppmw (including both encapsulated and unencapsulated molecules) in the finished formulation. The blending was effected by mixing the additive composition into the base fuel, and agitating the mixture until the solid was completely dissolved.

In order to assess the efficacy of the cetane improver in the fuel formulations, the standard test method IP 498/06 was used to measure their IQT cetane numbers. In addition, cetane numbers for the formulations were also tested in a research engine, using the standard test method ASTM D613 ("Determination of Ignition Delay and Derived Cetane Number (DCN) of Diesel Fuel Oils by Combustion in a Constant Volume Chamber").

For comparison purposes, both IQT and research engine cetane numbers were also measured for the base fuel alone, and for blends of the base fuel with unencapsulated EHN, ie EHN in the absence of the modified cyclodextrin.

The results of the cetane number measurements are shown in Table 11 below. "DCN (IQT)" refers to cetane numbers according to ASTM D613; "CN (RE)" refers to cetane numbers measured using the research engine; and "EHN-TRIMEB" refers to the host-guest complex formed between the modified cyclodextrin and the EHN additive. The "active" concentrations quoted refer to the EHN alone.

TABLE 11

| Test fuel | EHN conc$^n$ (ppmw) | EHN-TRIMEB conc$^n$ (ppmw) | Active EHN conc$^n$ (ppmw) | DCN (IQT) | CN (RE) |
|---|---|---|---|---|---|
| BF6 | 0 | 0 | 0 | 58.6 | 54.3 |
| BF6 + EHN | 400 | 0 | 400 | 58.7 | 53.8 |
| BF6 + EHN | 600 | 0 | 600 | 59.1 | 55.2 |
| BF6 + EHN | 800 | 0 | 800 | 60.1 | 55.8 |
| BF6 + EHN-TRIMEB | 0 | 2000 | 200 | 58.7 | 55.6 |
| BF6 + EHN-TRIMEB | 0 | 4000 | 400 | 59.6 | 55.7 |
| BF6 + EHN-TRIMEB + EHN | 600 | 600 | 660 | 60.0 | 54.9 |

It can be seen from Table 11 that the EHN continues to function as a cetane improver even when present as a guest molecule within the cyclodextrin inclusion complex. Moreover, its encapsulation appears to enhance its cetane improving activity (compare the figures for the formulations containing (a) 400 ppmw EHN and (b) 4,000 ppmw of the EHN-TRIMEB complex, which equates to 400 ppmw of active EHN).

Example 12

Choice of Modified Cyclodextrin

Three modified cyclodextrins of formula (I), and for comparison an unmodified cyclodextrin, were tested to assess their solubilities and stabilities in gasoline and diesel fuels and lubricants.

The cyclodextrins were the TRIMEB used in the previous examples; heptakis(2,6-di-O-n-butyl)-β-cyclodextrin (RABUB); hydroxypropyl-β-cyclodextrin (HPBCD); and unmodified β-cyclodextrin ($R^1$=$R^2$=$R^3$=hydrogen). The RABUB was sourced from Cyclolab R&D Laboratory (Hungary) and the unmodified cyclodextrin from Sigma-Aldrich.

The fuels tested were (a) gasoline base fuels containing 0, 5, 10, 25 and 85% v/v of ethanol (respectively, E0, E5, E10, E25 and E85); (b) 100% ethanol; (c) a diesel base fuel; (d) a winter-grade Fischer-Tropsch derived diesel fuel; and (e) a Yubase 4 (trade mark) Group III base oil, sourced from SK Energy, South Korea. Not all cyclodextrins were tested in all fuels and lubricants.

In each case, the cyclodextrin was added to the fuel or lubricant at a concentration of 1,000 ppmw and at room temperature.

The unmodified β-cyclodextrin was found to be insoluble in the E0 gasoline base fuel, the diesel base fuel, the Fischer-Tropsch derived fuel and the Yubase base oil. This demonstrates the unsuitability of the unmodified molecule as an additive or additive vehicle in typical fuel and lubricant formulations, despite the general reference to cyclodextrins in U.S. Pat. No. 3,314,884.

The TRIMEB formed a clear and bright solution in the E0 gasoline base fuel, and also in the diesel base fuel although here it required a long dissolution time. It could be partially dissolved in the Fischer-Tropsch derived fuel, with a very long dissolution time, but showed little dissolution in the base oil even with a very long dissolution time. Thus, the TRIMEB demonstrates higher solubilities in more polar environments.

The HPBCD formed hazy suspensions in the gasoline base fuel, at ethanol concentrations from 0 to 25% v/v, when included at 100 ppmw. However, it formed clear and bright solutions when included at 1,000 ppmw in the E85 gasoline fuel and 100% ethanol. It was not tested in the diesel fuels or the Yubase base oil.

The RABUB appeared to be very soluble in the E5 gasoline fuel and the diesel fuel, forming clear and bright solutions in both cases. It was found to be stable when stored at −20° C. for two weeks in the E5 gasoline. It was also the fastest-dissolving of the cyclodextrins tested. Other alkylated β-cyclodextrins, in particular those substituted with C2 or higher alkyl groups, for example C3 to C8 alkyl groups, can therefore also be expected to be soluble in automotive gasoline and diesel fuels, and to be suitable for use in such fuels as additives or additive-carrying vehicles.

Example 13

Solubility of Further Cyclodextrins

Three further modified cyclodextrins of formula (I) were tested for solubility in gasoline and diesel fuels.

The cyclodextrins were alkylated β-cyclodextrins, substituted respectively with ethyl (the compound referred to as RAEB), propyl (RAPB) and octyl (RAOB) groups. In each case the positions $R^1$, $R^2$ and $R^3$ were randomly substituted with the relevant alkyl group, there being on average at least 2 substitutions out of 3 per residue in each molecule. The propyl and octyl substituents were a mixture of linear and branched chain alkyl groups. All three compounds were sourced from Cyclolab R&D Laboratory (Hungary).

The fuels tested were (a) gasoline base fuels containing 0, 10 and 85% v/v of ethanol (respectively, E0, E10 and E85); (b) 100% ethanol; and (c) a B7 diesel base fuel containing 7% v/v of POME. The cyclodextrins were added to the fuels at a concentration of 1,000 ppmw and at room temperature. The approximate speeds of their dissolution, and the physical appearance of the resultant solutions, were assessed by eye. The observations are summarised in Table 12 below. "Second-scale dissolution time" indicates that the cyclodextrin dissolved in a matter of seconds (ie less than a minute); "minute-scale dissolution time" means that it dissolved within several minutes but less than an hour; "hour-scale" means that it took more than one hour to dissolve.

TABLE 12

| Fuel | RAEB | RAPB | RAOB |
|---|---|---|---|
| E0 gasoline | Clear and bright; minute-scale dissolution time | Clear and bright; dissolved on contact | Clear and bright; dissolved on contact |
| E10 gasoline | Clear and bright; dissolved on contact | Clear and bright; dissolved on contact | Clear and bright; dissolved on contact |
| E85 gasoline | Clear and bright; dissolved on contact | Clear and bright; second-scale dissolution time | Clear and bright; dissolved on contact |
| Ethanol | Clear and bright; second-scale dissolution time | Clear and bright; minute-scale dissolution time | Clear and bright; minute-scale dissolution time |
| B7 diesel | Clear and bright; hour-scale dissolution time | Clear and bright; second-scale dissolution time | Clear and bright; dissolved on contact |

It can be seen from Table 12 that all of the alkylated cyclodextrins tested had good solubilities in gasoline, ethanol and ethanol-containing gasoline. The degree of solubility and speed of dissolution appear to be linked to the respective polarities of the cyclodextrin and the fuel. The polarity of the cyclodextrins increases from low (RAOB) to high (RAEB). The polarity of the fuels increases from low (E0 gasoline) to high (ethanol). In the highest polarity fuel, ethanol, the lowest polarity cyclodextrin RAOB proved the hardest to dissolve, as evidenced by its longer dissolution time. In the lowest polarity fuel (E0), the highest polarity cyclodextrin RAEB was the hardest to dissolve. In the relatively low polarity B7 diesel fuel, again the lowest polarity cyclodextrin RAOB was the easiest to dissolve. Thus, the substituents on a modified cyclodextrin (I) may be tailored to increase its affinity for a specific type of fuel in which it is intended to be used.

Example 14

Additive Stability

Formulations containing 1,000 ppmw of TRIMEB dissolved in the E10, E25, E50 and E100 gasoline fuels were stored at approximately 20° C., −2° C. and −20° C. for a period of six months. All of the solutions remained clear and bright throughout the six month storage period, even at the lowest temperature. Similar results were observed in an EU gasoline fuel containing a PIB amine detergent additive, and also in a diesel base fuel once allowed to return to room temperature.

Formulations containing 1,000 ppmw of the BHT-TRIMEB complex (ex Cyclolab R&D Laboratory (Hungary)) dissolved in the diesel base fuel BF5 were stored at approximately 20° C., 0° C. and −20° C. for six months. At given time intervals across the six-month period, the formulations were allowed to stabilise at room temperature and visually assessed. The samples being stored at 0 and 20° C. remained clear and bright throughout the test period, whilst those stored at −20° C. showed a waxy appearance no different to that exhibited by the base fuel alone, becoming clear and bright after thawing to ambient temperature.

Formulations containing 1,000 ppmw of the BHT-TRIMEB complex dissolved in the E0 (ie ethanol-free) gasoline base fuel BF1 were stored at approximately 20° C., 0° C. and −20° C. for six months. All remained clear and bright throughout the test period, although after six months there was a slight precipitate visible in the sample stored at −20° C. The test was repeated using BF2 (the gasoline base fuel containing 420 ppmw of a PIB amine detergent additive): all samples remained clear and bright throughout.

These results indicate that modified cyclodextrins of formula (I), and complexes containing active substances within such cyclodextrins, can be suitable for use in hydrocarbon-based fuel and lubricant formulations without solubility or stability issues.

In additional tests, it was found that the inclusion of up to 10,000 ppmw of TRIMEB had no significant effect on the distillation properties of either an E0 gasoline base fuel or a B7 diesel base fuel. Similar results were obtained when the diesel base fuel contained up to 10,000 ppmw of the BHT-TRIMEB or DTBP-TRIMEB complexes, and when the gasoline base fuel contained up to 10,000 ppmw of the BHT-TRIMEB or NMA-TRIMEB complexes.

The results from this and Examples 12 and 13 confirm the utility of modified cyclodextrins of formula (I), in particular alkylated cyclodextrins, as additives in fuel and lubricant formulations and especially in gasoline and diesel fuel formulations. They also demonstrate the "tuneability" of the compounds, as the substituents $R^1$ to $R^3$ can be tailored in order to optimise their solubility and stability in any given formulation.

We claim:

1. A gasoline formulation comprising the additive composition comprising a cyclodextrin inclusion complex containing:

(i) an active substance; and (ii) a modified cyclodextrin of formula (I):

(I)

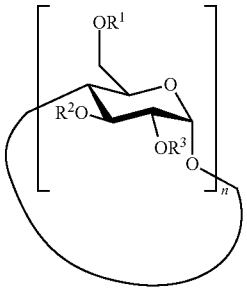

wherein n is an integer from 6 to 20, and $R^1$, $R^2$ and $R^3$ are each independently selected from hydrogen, optionally substituted alkyl, optionally substituted aryl and carbonyl, provided that $R^1$, $R^2$ and $R^3$ are not all hydrogen, the active substance being present as a guest molecule within a host molecule of the modified cyclodextrin (I), in the form of an inclusion complex.

2. The formulation of claim 1, wherein the formulation is a gasoline fuel formulation.

3. A method comprising:

introducing an additive composition in a gasoline formulation into a gasoline formulation consuming system, wherein the additive composition comprises a cyclodextrin inclusion complex containing:

(i) an active substance; and (ii) a modified cyclodextrin of formula (I):

(I)

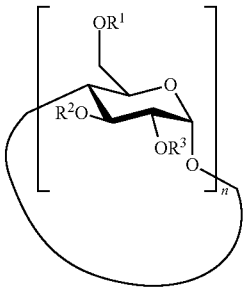

wherein n is an integer from 6 to 20, and $R^1$, $R^2$ and $R^3$ are each independently selected from hydrogen, optionally substituted alkyl, optionally substituted aryl and carbonyl, provided that $R^1$, $R^2$ and $R^3$ are not all hydrogen, the active substance being present as a guest molecule within a host molecule of the modified cyclodextrin (I), in the form of an inclusion complex;

and subsequently subjecting the composition to a condition which induces at least partial release of the active substance from the inclusion complex.

4. An additive composition for use in a gasoline formulation comprising a cyclodextrin inclusion complex containing:

(i) an active substance;

(ii) a modified cyclodextrin of formula (I):

(I)

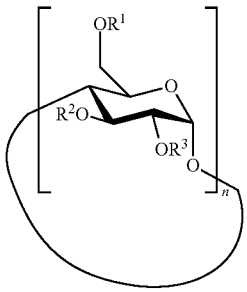

wherein n is an integer from 6 to 20, and $R^1$, $R^2$ and $R^3$ are each independently selected from hydrogen, optionally substituted alkyl, optionally substituted aryl and carbonyl, provided that $R^1$, $R^2$ and $R^3$ are not all hydrogen, the active substance being present as a guest molecule within a host molecule of the modified cyclodextrin (I), in the form of an inclusion complex;

and (iii) one or more carriers which are suitable for use in a fuel or lubricant formulation.

5. The fuel or lubricant formulation of claim 1, wherein in the modified cyclodextrin of formula (I), the groups $R^1$, $R^2$ and $R^3$ are independently selected from hydrogen and unsubstituted C1 to C12 alkyl groups.

6. The fuel or lubricant formulation of claim 5, wherein at least two of $R^1$, $R^2$ and $R^3$ are independently selected from unsubstituted C1 to C12 alkyl groups.

7. The fuel or lubricant formulation of claim 6, wherein two of the groups $R^1$, $R^2$ and $R^3$ are independently selected from unsubstituted C2 to C8 alkyl groups.

8. The fuel or lubricant formulation of claim 1, wherein in the modified cyclodextrin of formula (I), the integer n is from 6 to 8.

9. The fuel or lubricant formulation of claim 8, wherein in the modified cyclodextrin of formula (I), the integer n is 7.

10. The fuel or lubricant formulation of claim 1, wherein the active substance is an antioxidant.

11. The gasoline formulation of claim 1, wherein the active substance and the modified cyclodextrin (I) are such that the active substance is released from the cyclodextrin inclusion complex when the additive composition is subjected to a temperature above or below a predetermined value, and/or to a pressure above or below a predetermined value, and/or is exposed to another species.

* * * * *